US007421969B2

(12) United States Patent
Mercier et al.

(10) Patent No.: US 7,421,969 B2
(45) Date of Patent: Sep. 9, 2008

(54) RETRACTABLE WINDSHIELD FOR A BOAT

(75) Inventors: Daniel Mercier, Magog (CA); Philip Godfrey, Sherbrooke (CA); Claude Gagnon, Magog (CA); Andre Cote, Longueuil (CA); Denys Lapointe, Saint-Bruno (CA); Mathieu Duquette, Sherbrooke (CA); Alex Miklosi, Lennoxville (CA)

(73) Assignee: BRP US Inc., Sturtevant, WI (US)

( * ) Notice: Subject to any disclaimer, the term of this patent is extended or adjusted under 35 U.S.C. 154(b) by 31 days.

(21) Appl. No.: 11/532,720

(22) Filed: Sep. 18, 2006

(65) Prior Publication Data

US 2007/0186839 A1 Aug. 16, 2007

Related U.S. Application Data

(60) Provisional application No. 60/773,308, filed on Feb. 15, 2006.

(51) Int. Cl.
*B63B 17/00* (2006.01)

(52) U.S. Cl. ..... 114/361

(58) Field of Classification Search ..... 114/361; 296/89

See application file for complete search history.

(56) References Cited

U.S. PATENT DOCUMENTS

| | | | | |
|---|---|---|---|---|
| 2,102,123 | A | 12/1937 | Leveau | |
| 2,308,109 | A | 1/1943 | Rundquist | |
| 2,836,140 | A | 5/1958 | Hunt, Jr. | |
| 3,021,535 | A | 2/1962 | Dorst | |
| 3,093,846 | A | 6/1963 | Reid | |
| 3,099,023 | A | 7/1963 | Buchholz et al. | |
| 3,121,924 | A * | 2/1964 | Beisel | 52/656.6 |
| 3,123,839 | A | 3/1964 | Reid | |
| 3,134,112 | A | 5/1964 | Hage | |
| 3,161,895 | A | 12/1964 | Lewis | |
| 3,290,706 | A | 12/1966 | Hale | |
| 3,304,657 | A | 2/1967 | Singleton | |
| 3,312,990 | A | 4/1967 | Lapworth | |
| 3,320,698 | A | 5/1967 | Hummel | |
| 3,336,612 | A * | 8/1967 | Stevens | 114/361 |
| 3,906,563 | A * | 9/1975 | Bramhall | 114/361 |

(Continued)

OTHER PUBLICATIONS

U.S. Appl. No. 11/532,309, Retractable Windshield for a Boat, filed Sep. 15, 2006.

*Primary Examiner*—Sherman Basinger
(74) *Attorney, Agent, or Firm*—Osler, Hoskin & Harcourt LLP

(57) ABSTRACT

A boat has a hull and a deck supported by the hull. The deck has a rearward passenger area. A seat is disposed in the rearward passenger area. A first console is disposed on the deck at a front of the rearward passenger area and forwardly of the seat. The first console has a top. A first windshield is disposed generally transverse to a longitudinal axis of the boat. The first windshield is movable between a first position where the first windshield extends a first distance vertically above the top of the first console and a second position where at least a portion of the first windshield extends a second distance vertically below the top of the first console. When the first windshield is in the second position the at least one portion of the first windshield is in a substantially vertical position.

20 Claims, 22 Drawing Sheets

U.S. PATENT DOCUMENTS

| | | | | |
|---|---|---|---|---|
| 4,926,782 | A | 5/1990 | Lacy | |
| 4,957,056 | A | 9/1990 | Martin | |
| 4,970,946 | A | 11/1990 | Ivey | |
| 5,092,262 | A | 3/1992 | Lacy | |
| 5,121,703 | A | 6/1992 | Smith | |
| 5,203,277 | A | 4/1993 | Norman | |
| 5,303,667 | A | 4/1994 | Zirkelbach et al. | |
| 5,309,860 | A * | 5/1994 | Shearer | 114/361 |
| 5,419,604 | A | 5/1995 | Clark | |
| 5,505,156 | A * | 4/1996 | Briggs | 114/361 |
| 5,697,320 | A | 12/1997 | Murray | |
| 6,672,240 | B1 | 1/2004 | Aube et al. | |
| 6,837,173 | B2 | 1/2005 | Eck et al. | |
| 6,886,490 | B2 | 5/2005 | Aube et al. | |
| 2007/0186838 | A1 * | 8/2007 | Mercier et al. | 114/361 |

* cited by examiner

RETRACTABLE WINDSHIELD FOR A BOAT

CROSS-REFERENCE

The present application claims priority to U.S. Provisional Patent Application No. 60/773,308 filed on Feb. 15, 2006, the entirety of which is incorporated herein by reference.

FIELD OF THE INVENTION

The present invention relates to a boat having a retractable windshield.

BACKGROUND OF THE INVENTION

Passenger boats are often provided with a windshield in front of a rearward passenger area. The windshield shields the rearward passenger area from the wind when the boat is moving on the water. However, some passengers seated in that area might like to feel the wind while the boat is moving.

In cases where the boat is provided with a forward passenger area forwardly of the windshield, the windshield also hinders communications between the passengers in the forward and the rearward passenger areas.

Boats with a forward and rearward passenger areas generally have a passageway communicating the two areas. These boats are often provided with a central windshield disposed in the passageway to provide additional shielding. However, since the windshield does not extend completely to the floor of the boat, wind can still pass through the passageway, which in some cases it may be desired to minimize.

Some of the above-mentioned concerns have been addressed by the prior art. For example, in most boats having a central windshield, the central windshield is hinged to the windshield beside it. This allows the central windshield to be pivoted onto the windshield to which it is hinged. This system provides easy access between the two passenger areas and the central windshield can easily be moved to a position where it does not shield from the wind. However, the fact that the central windshield rests on another windshield may cause either, or both, to become scratched. Also if the central windshield is narrower than the windshield on which it rests, as is often the case, the frame of the central windshield may obstruct the view through the windshield on which it rests.

Other systems provide a central windshield that can be moved to a position where it no longer shields the passengers by moving the central windshield forwardly while pivoting it to a generally horizontal position. However, having the windshield in a horizontal position takes up a lot of space that could otherwise be occupied by passengers.

Therefore, there is a need for a boat with a windshield that can be moved to a position where it provides less shielding from the wind.

There is also a need for a boat with a windshield that can be moved to a position which facilitates the communication between the passengers in the forward passenger area and the passengers in the rearward passenger area of the boat.

There is also a need for a boat which provides additional shielding from the wind in the passageway between the forward and rearward passenger areas. Moreover, for the same reasons as those mentioned above, and for providing easy access from one passenger area to the other, there is also a need to have the additional shielding and the central windshield move to a position where they would no longer be shielding or where shielding is reduced.

There is also a need for a boat with a windshield that can move to a position in which shielding from the wind is reduced and which does not take up too much space on the boat while in that position.

SUMMARY OF THE INVENTION

It is an object of the present invention to ameliorate some of the inconveniences present in the prior art.

It is an object of the present invention to provide a boat having a windshield which can be retracted to a non-shielding position.

In one aspect, the invention provides a boat having a hull and a deck supported by the hull. The deck has a rearward passenger area. A seat is disposed in the rearward passenger area. A first console is disposed on the deck at a front of the rearward passenger area and forwardly of the seat. The first console has a top. A first windshield is disposed generally transverse to a longitudinal axis of the boat. The first windshield is movable between a first position where the first windshield extends a first distance vertically above the top of the first console and a second position where at least a portion of the first windshield extends a second distance vertically below the top of the first console. When the first windshield is in the second position, the at least one portion of the first windshield is in a substantially vertical position.

In an additional aspect, when it is in the second position, the first windshield is disposed inside the first console.

In a further aspect, when it is in the second position, the first windshield is completely below the top of the first console.

In an additional aspect, the first windshield slides between the first and the second positions.

In a further aspect, the boat has a pair of slide frames connected to the first console. The first windshield slides in the slide frames when moving between the first and the second positions.

In an additional aspect, the boat has a side windshield disposed at an angle to the first windshield. The side windshield is movable between a first position where the side windshield is disposed above a side of the deck and a second position where at least a portion of the side windshield is disposed below the side of the deck.

In a further aspect, the side windshield pivots between the first and the second positions.

In a further aspect, the first console and the first windshield are disposed on a first side of the longitudinal axis of the boat. The boat also has a second console disposed on the deck on a second side of the longitudinal axis of the boat and a second windshield disposed on the second side of the longitudinal axis of the boat.

In an additional aspect, the second windshield is movable between a first position where the second windshield extends a third distance vertically above the top of the second console and a second position where at least a portion of the second windshield extends a fourth distance vertically below the top of the second console. When the second windshield is in the second position, the at least one portion of the second windshield is in a substantially vertical position In a further aspect, the first and second windshields slide between their respective first and second positions.

In an additional aspect, when the first windshield is in its second position, the at least one portion of the first windshield is disposed inside the first console and, when the second windshield is in its second position, the at least one portion of the second windshield is disposed inside the second console.

In a further aspect, the boat has a third windshield disposed between the first and second windshields, such that when the first windshield is in the first position, the first, second, and third windshields form together a continuous windshield spanning at least a majority of a width of the deck.

In an additional aspect, the deck has a forward passenger area. A passageway between the first and the second consoles allows for communication between the forward passenger area and the rearward passenger area. A door is disposed on the deck for selectively closing the passageway between the forward passenger area and the rearward passenger area. The door has a top. The third windshield is operatively connected to the door.

In a further aspect, the third windshield is movable between a first position where the third windshield extends a fifth distance vertically above the top of the door and a second position where at least a portion of the third windshield extends a sixth distance vertically below the top of the door.

In an additional aspect, each one of the second and third windshields is movable between a first position and a second position. When in their respective first positions, each of the first, second, and third windshields forms a portion of the continuous windshield.

In a further aspect, each one of the first, second, and third windshields is movable independently of the others.

In an additional aspect, each one of the first, second, and third windshields is slidable between its respective first and second positions.

In a further aspect, each of the first and second windshields is slidable between its respective first and second positions, and the third windshield is rotatable between its first and second positions.

In an additional aspect, the boat has an actuator for moving the first windshield between the first and the second positions.

In a further aspect, the actuator includes an electric motor.

In an additional aspect, the seat is a driver's seat.

For purposes of this application, the terms "extend a [first/second/third/fourth] distance vertically above" mean that a first element extends a distance measured vertically between the top of the first element and the top of a second element above which the first element extends. These terms are understood to comprise the case where the first element extends completely below the top of the second element, in which case the distance is considered to be zero. Also for purposes of this application, the terms "substantially vertical position" mean that an element is positioned in space such that the height of the projection of the element onto a vertical plane facing the element is greater than the length (measured perpendicularly to the vertical plane) of the projection of the element onto a horizontal plane. For example, a windshield disposed transverse to a longitudinal axis of a boat is considered to be in a substantially vertical position when the height of the projection of the windshield onto a vertical plane disposed transverse to the longitudinal axis of the boat (i.e. facing the windshield) is greater then the length, measured in a direction parallel to the longitudinal axis of the boat (i.e. perpendicular to the vertical plane), of the projection of the windshield onto a horizontal plane. In the case of a windshield disposed parallel to the longitudinal axis of the boat, the vertical plane onto which the windshield would be projected would be parallel to the longitudinal axis and the length of the projection onto the horizontal plane would be measured in the direction transverse to the longitudinal axis of the boat.

Embodiments of the present invention each have at least one of the above-mentioned objects and/or aspects, but do not necessarily have all of them.

Additional and/or alternative features, aspects, and advantages of the embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
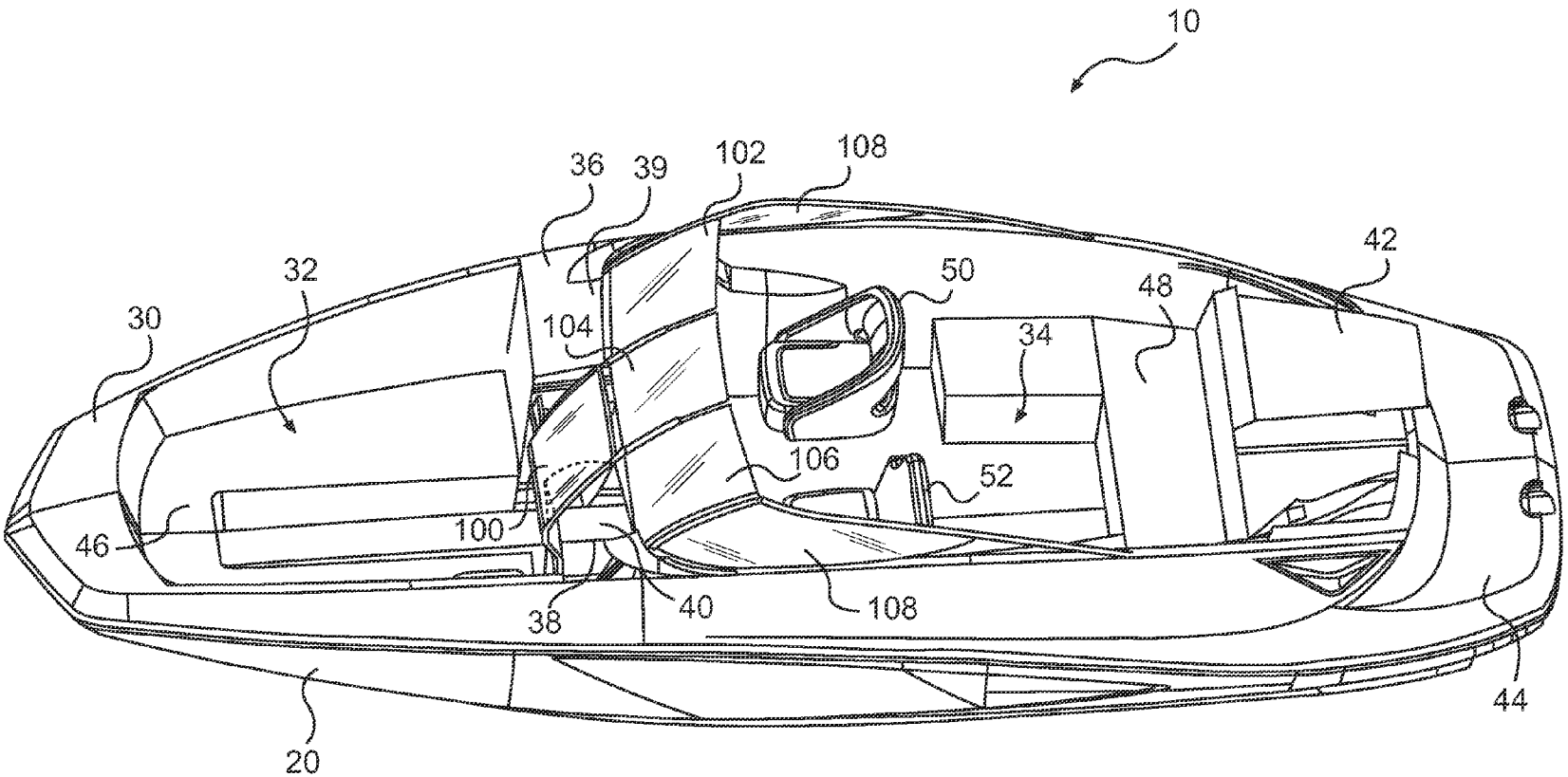
FIG. 1 is a perspective view, taken from a left side, of a first embodiment of a boat in accordance with the present invention, with the windshields in a shielding position and the door in a closed position.
Figure 2:
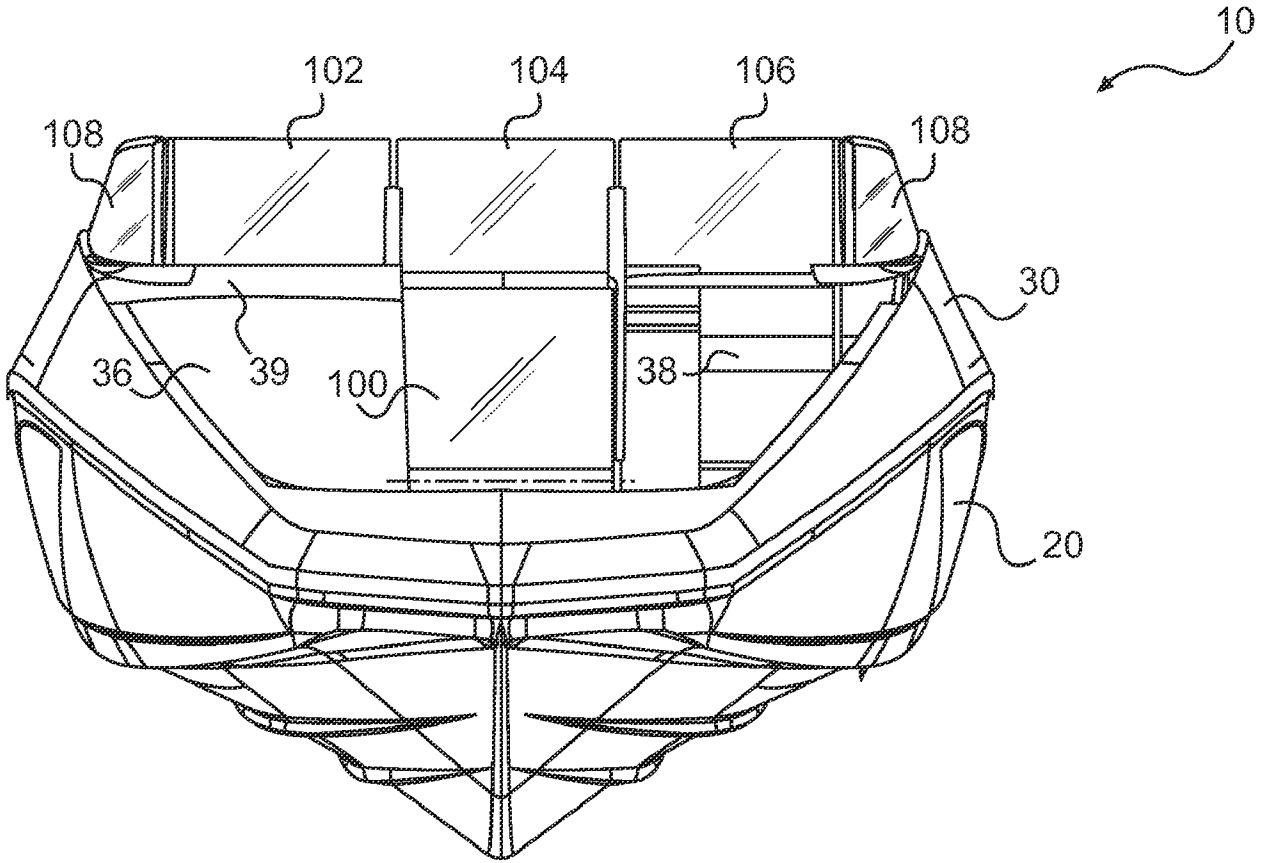
FIG. 2 is a perspective view, taken from a front, of the boat of FIG. 1.

Turning now to the figures, FIGS. 1 and 2 illustrate a boat 10 having a hull 20 and a deck 30 supported by the hull 20. The deck 30 has a forward passenger area 32 and a rearward passenger area 34. A right console 36 and a left console 38 (in phantom in FIG. 1) are disposed on either side of the deck 30 between the two passenger areas 32, 34. A passageway 40 disposed between the two consoles 36, 38 allows for communication between the two passenger areas 32, 34. At least one engine (not shown) is located between the hull 20 and the deck 30 at the back of the boat 10. The engine powers the propulsion system (not shown) of the boat 10, which can be of any form, such as, for example, jet propulsion, stem drive, or propeller. The engine is accessible through an engine cover 42 located behind the rearward passenger area 34. The engine cover 42 can also be used as a sundeck for a passenger of the boat 10 to sunbathe on while the boat 10 is not in motion. A reboarding platform 44 is located at the back of the deck 30 for passengers to easily reboard the boat 10 from the water.

The forward passenger area 32 has a C-shaped seating area 46 for passengers to sit on. The rearward passenger area 34 also has a C-shaped seating area 48 at the back thereof. A driver seat 50 facing the right console 36 and a passenger seat 52 facing the left console 34 are also disposed in the rearward passenger area 34. It is contemplated that the driver and passenger seats 50, 52 can swivel so that the passengers occupying these seats can socialize with passengers occupying the C-shaped seating area 48. The right and left consoles 36, 38 extend inwardly from their respective side of the boat 10. At least a portion of each of the right and the left consoles 36, 38 is integrally formed with the deck 30. The right console 36 has a recess 54 formed on the lower portion of the back thereof to accommodate the feet of the driver sitting in the driver seat 50 and an angled portion of the right console 36 acts as a footrest 56. The left console 38 has a similar recess (not shown) to accommodate the feet of the passenger sitting in the passenger seat 52. The right console 36 accommodates all of the elements necessary to the driver to operate the boat. These include, but are not limited to, a steering wheel 58, throttle and directional control levers 60, and an instrument panel 62. The instrument panel 62 have various dials indicating the vehicle speed, engine speed, fuel and oil level, and engine temperature. It is contemplated that the elements attached to the right console 36 could be different than those mentioned above. The left console 38 incorporates a storage compartment (not shown) which is accessible to the passenger sitting the passenger seat 52.

It should be noted that other deck configurations are contemplated which would not deviate from the present invention. For example, the boat 10 could have more or less seats, or the reboarding platform 44 may not be present.

Figure 7:
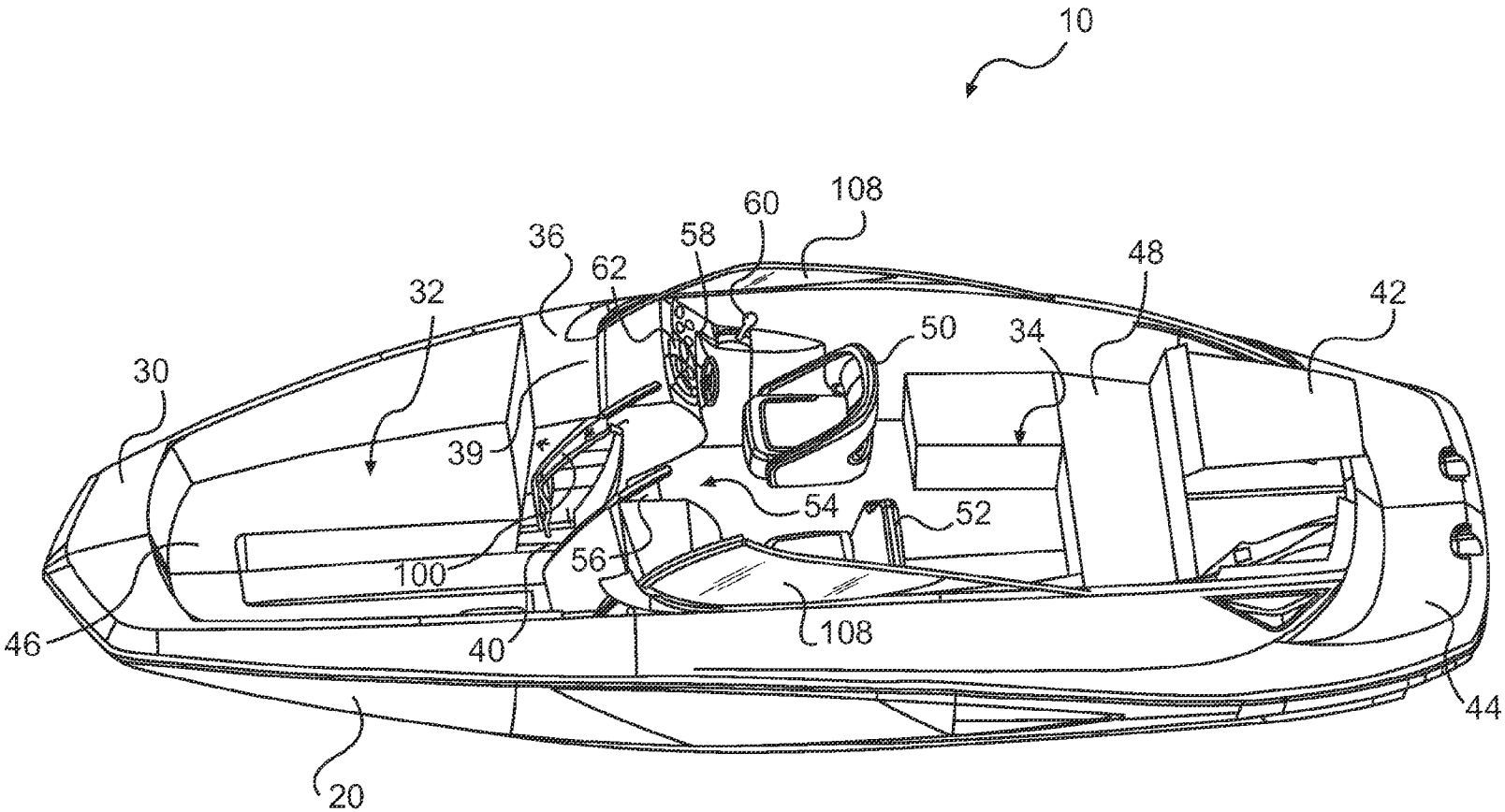
FIG. 7 is a perspective view, taken from a left side, of the boat of FIG. 1, with the windshields in the retracted position and the door in the opened position.
Figure 8:
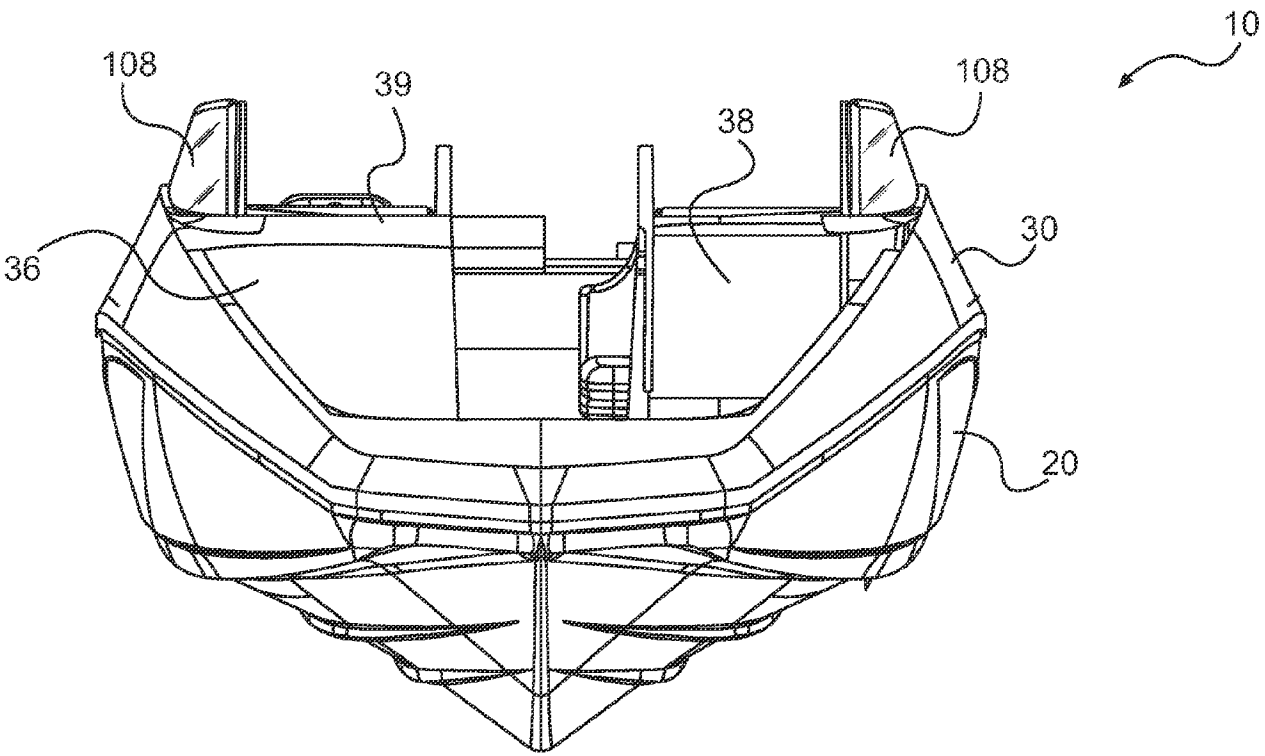
FIG. 8 is a perspective view, taken from a front, of the boat of FIG. 7.

In a first embodiment, a door 100 is provided on the deck 30 for selectively closing passageway 40 between the forward and rearward passenger areas 32, 34. As will be described in more details below, the door 100 can be retracted inside the right console 36, as shown in FIGS. 7 and 8. It is also contemplated that the door 100 could be retracted inside the left console 38, or that the door 100 could pivot between its opened and closed positions about a vertical axis located to one side of the door 100. When it is closed, as shown in FIGS. 1 and 2, the door 100 shields the passengers in the rearward passenger area 34 from the wind while the boat 10 is moving. The door 100 is preferably made of fiberglass or plastic.

A right windshield 102 is provided on the right console 36. A central windshield 104 is disposed above the door 100 when the door is in a closed position, as shown in FIG. 1. A left windshield 106 is provided on the left console 38. The right, central, and left windshields 102, 104, and 106 form together a generally curved continuous windshield spanning a majority of the width of the deck 30, as shown in FIGS. 1 and 2. The windshields 102, 104, and 106 shield the passengers in the rearward passenger area 34 from the wind while the boat 10 is moving. As will be explained below, one or more of the windshields 102, 104, and 106 can be retracted. This allows the passengers located behind the particular windshield being retracted to feel the wind while the boat 10 is moving and facilitates socializing between passengers in the forward and rearward passenger areas 32, 34 while the boat 10 is at rest. A pair of side windshields 108 is also provided on either side of the deck 30 to shield the passengers in seats 50 and 52 from side winds while the boat 10 is moving. The windshields 102, 104, 106, 108 are preferably made of tempered glass. It is contemplated that the windshields 102, 104, 106, 108 could also be made of a clear plastic.

Turning now to FIGS. 3 to 8, the method by which the windshields 102, 104, and 106 and door 100 are retracted will be explained. Note that in FIGS. 3 to 6 and 9 all elements of the boat 10 have been removed, except the windshields 102, 104, 106, door 100, and their related elements, in order to facilitate understanding.

Figure 3:
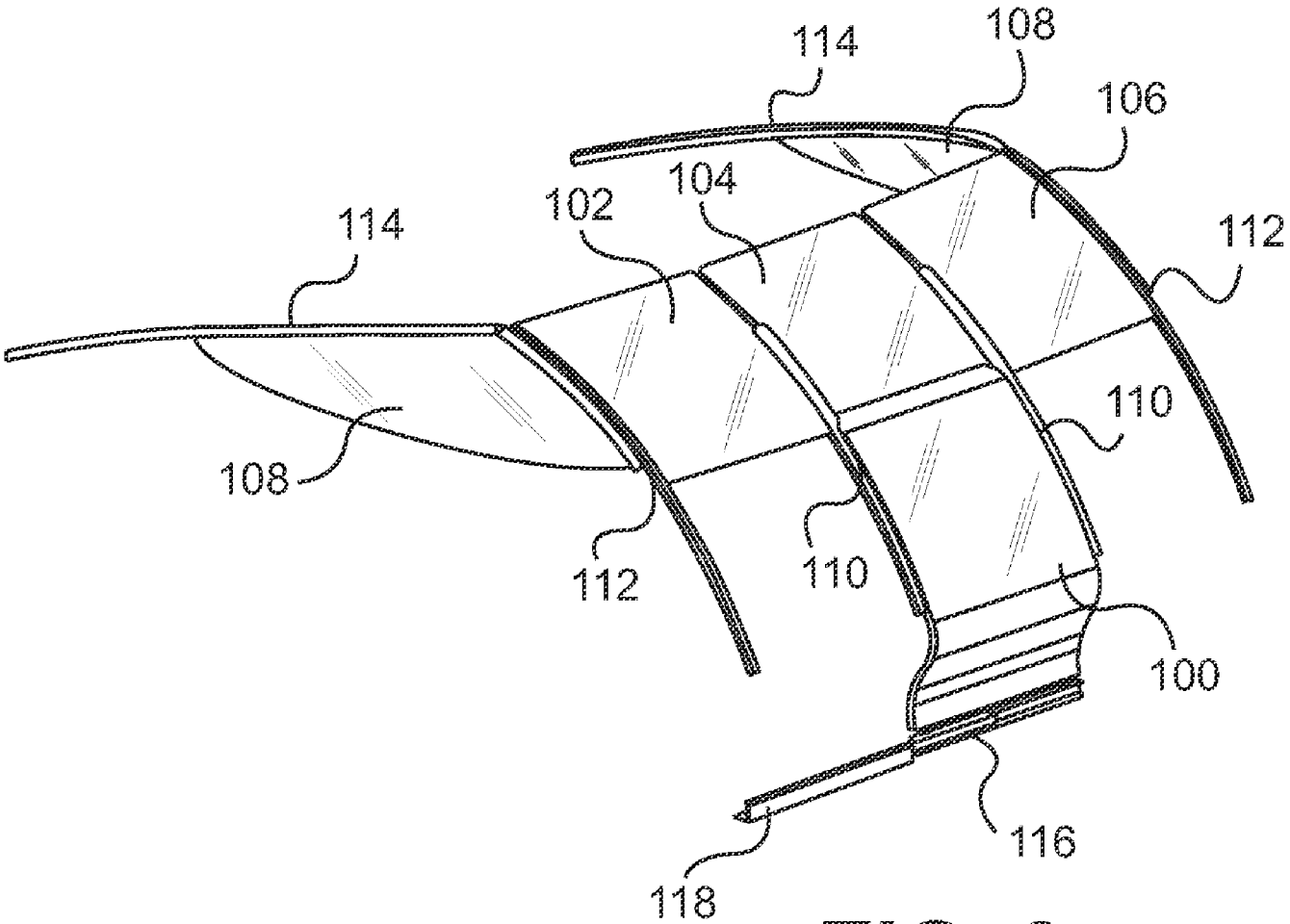
FIG. 3 is a perspective view, taken from a front, right side, of a windshield and door system of the boat of FIG. 1, with the windshields in the shielding position and the door in the closed position.

A pair of central slide frames 110 are provided on either side of the central windshield 104. The central slide frames 110 have grooves (not shown) which hold the central windshield 104 while it is in a first shielding position where the central windshield 104 extends a first distance vertically above the top of the door 100 as shown in FIG. 3. The central slide frames 110 also each have a groove (not shown) which holds one side of a corresponding one of the right and left windshields 102, 106. The other side of the right and left windshields 102, 106 are each held by a groove (not shown) in a side slide frame 112. The side windshields 108 are held in place by the side slide frames 112 at the front thereof and by a top frame 114 at a top thereof. The central slide frames 110 and the side slide frames 112 are preferably made of aluminum and have plastic inserts located in their respective grooves.

Figure 5:
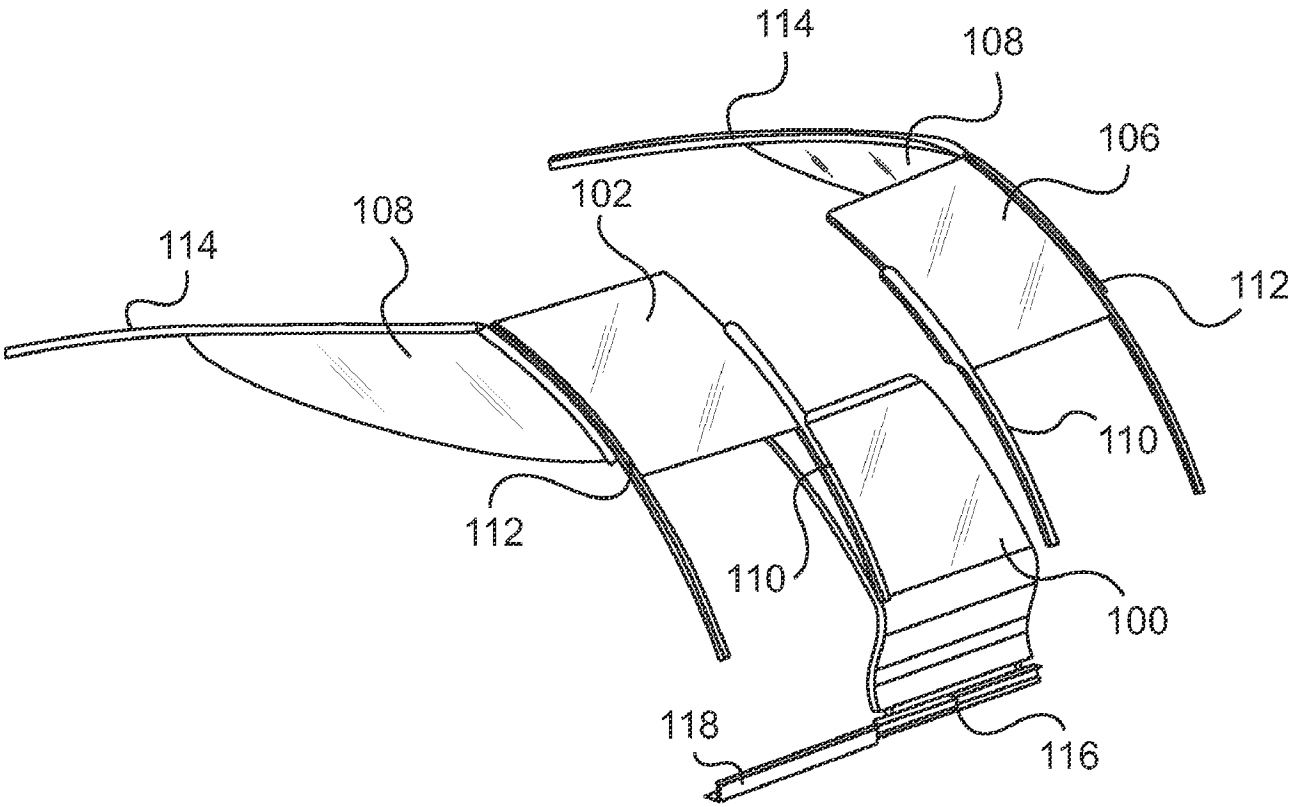
FIG. 5 is a perspective view, taken from a front, right side, of the windshield and door system of FIG. 3, with the central windshield in the retracted position and the door in a pivoted position.

The door 100 is attached to a slide rail 116 and is pivotable about the slide rail 116, as shown in FIG. 5, for reasons which will be explained below. A fixed portion 118 of the slide rail 116 is located inside the right console 36. It is contemplated that the door 100 could alternatively be provided with wheels that would roll inside a track in the floor of the deck 30. As seen in FIG. 3, it should be noted that the bottom portion of the door 100 is almost vertical compared to the rest of the door 100 which is at an angle. This is done so that the door 100 takes less space in the forward passenger area 32.

Figure 4:
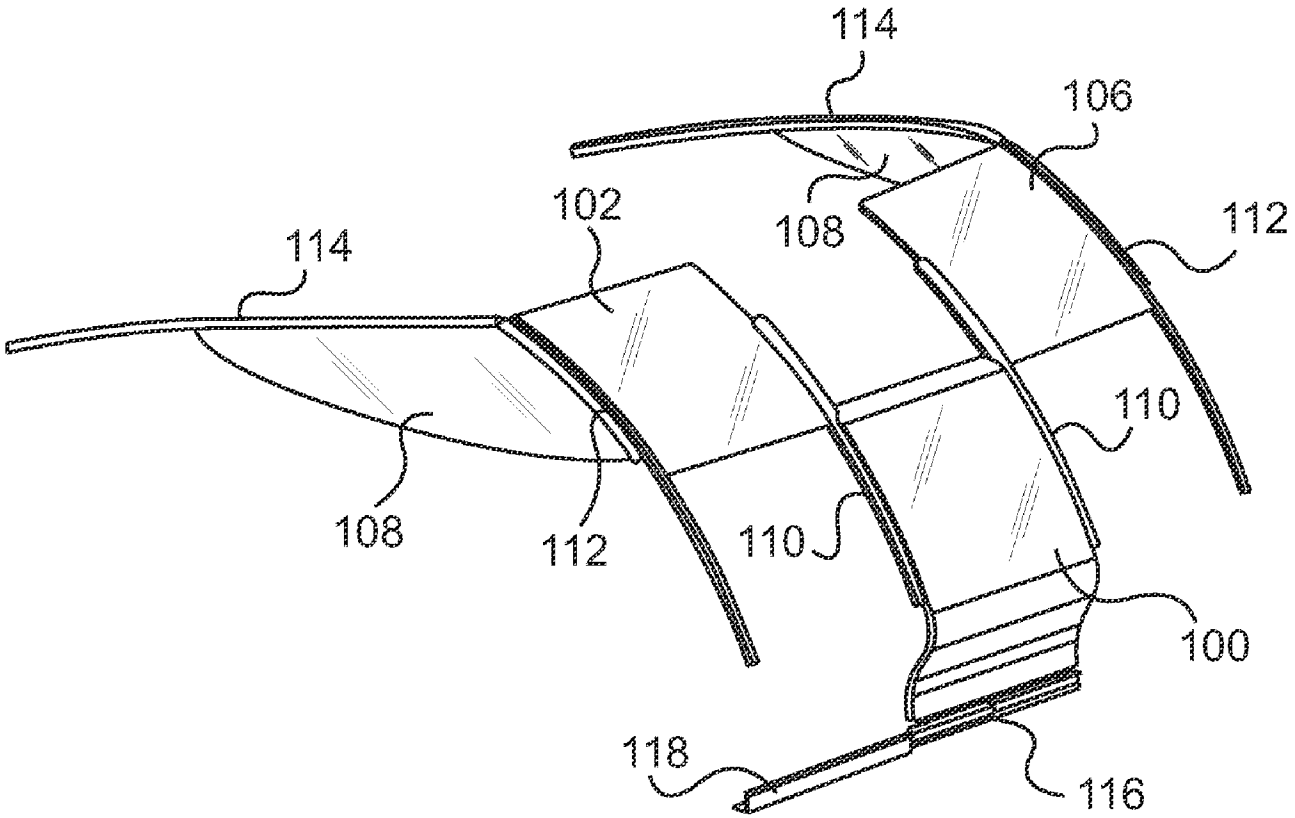
FIG. 4 is a perspective view, taken from a front, right side, of the windshield and door system of FIG. 3, with the central windshield in a retracted position and the door in the closed position.

The central windshield 104 can slide down along central slide frames 110 to a second retracted position where the central windshield 104 is located inside the door 100 and extends completely below the top of the door 100, as shown in FIG. 4. It is contemplated that the central windshield 104 could slide down only partially inside door 100 so as to adjust a degree of shielding provided thereby. It is also contemplated that the central windshield 104 could slide in front of or behind the door 100.

Figure 6:
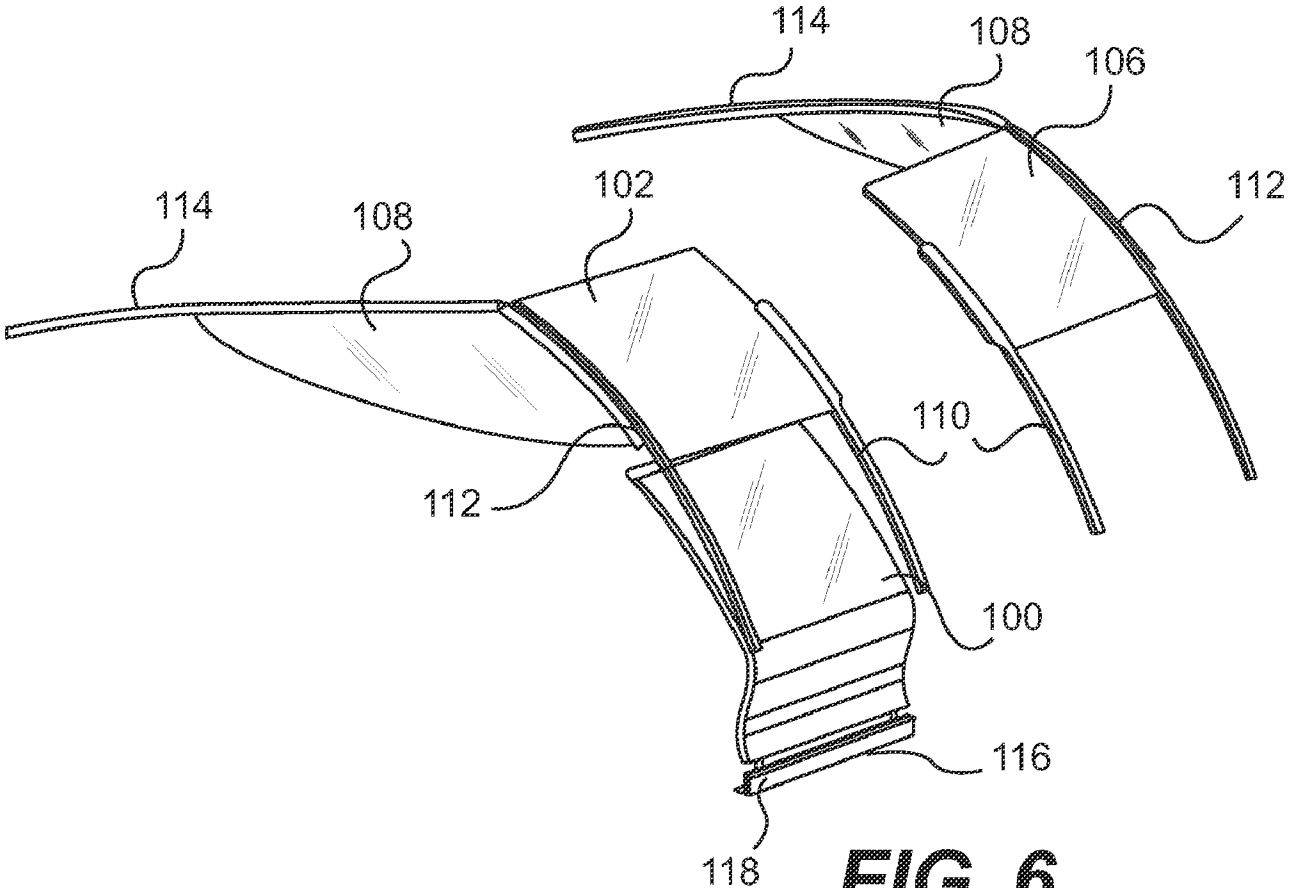
FIG. 6 is a perspective view, taken from a front, right side, of the windshield and door system of FIG. 3, with the central windshield in the retracted position and the door in an opened position.

To open the door 100, once the central windshield 104 is retracted inside the door 100, the door 100 is first pivoted rearwardly about the slide rail 116 so as to disengage central slide frames 110, as shown in FIG. 5. The door 100 is then pushed along slide rail 116 inside the right console 36, as shown in FIG. 6. The reverse method is used to close the door 100. Note that the central slide frames 110 are shaped to prevent the door 100 to be pivoted too far forward when it is moved back to a closed position. A latch (not shown) keeps the central windshield 104 in its shielding position. Additional latches (not shown) keep the door 100 in its closed and opened positions.

Figure 9:
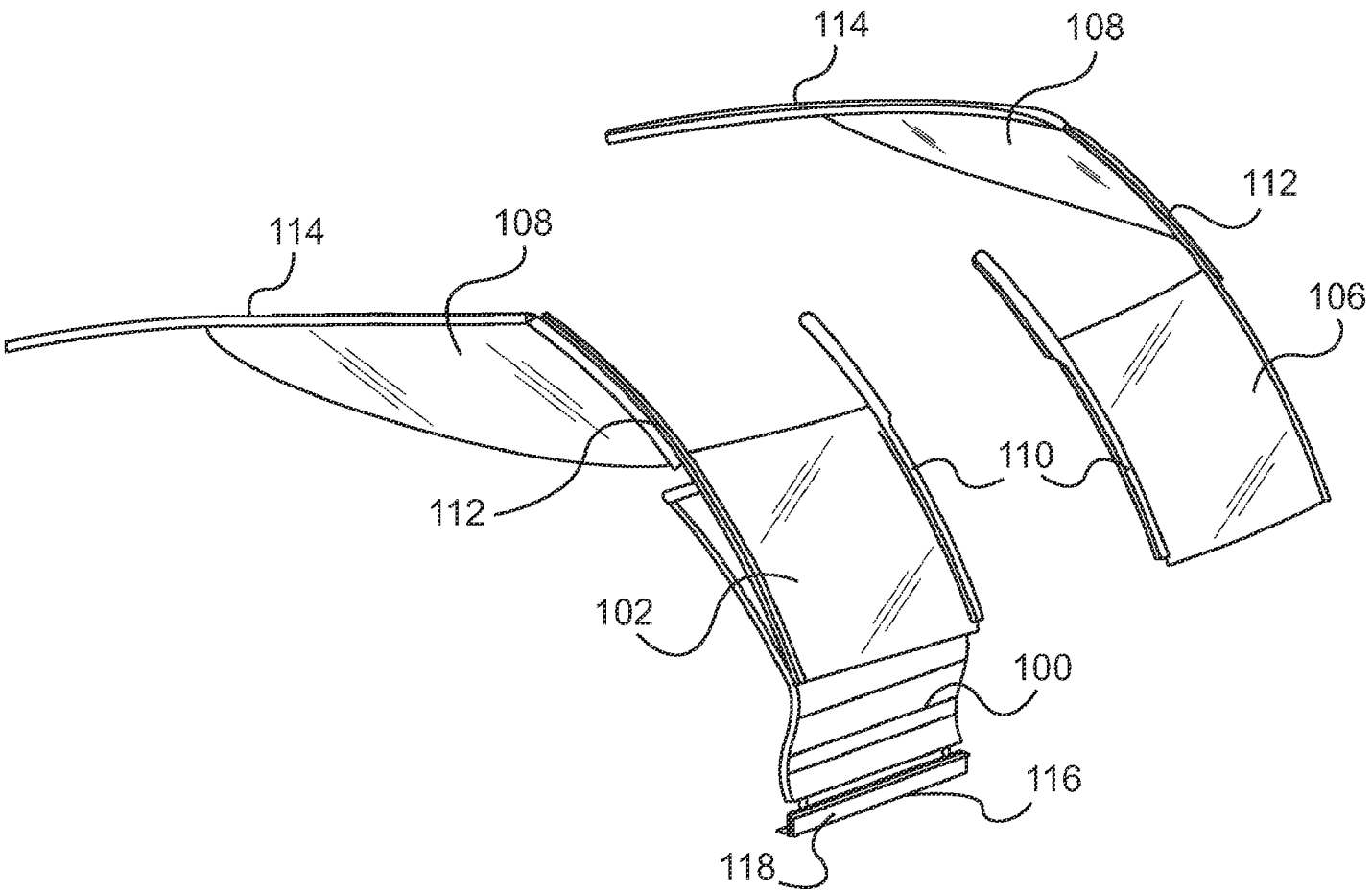
FIG. 9 is a perspective view, taken from a front, right side, of the windshield and door system of FIG. 3, with the windshields in the retracted position and the door in the opened position.

The right and left windshields 102, 106 can, independently from one another, slide down along their corresponding central and side slide frames 110, 112 from a first shielding position, where the right and left windshields 102, 106 extend a first distance vertically above their corresponding consoles 36, 38, to a second retracted position, where the right and left windshields 102, 106 are located inside their corresponding consoles 36, 38 and extend below the top 39 of their corresponding consoles 36, 38, as shown in FIGS. 7 to 9. Note that the central and side slide frames 110, 112 are shaped such that when the right and left windshields 102, 106 are in their second retracted position, they are in a substantially vertical position. By doing this, the right and left windshields 102, 106 take up less longitudinal space while in their second retracted position, thus allowing the size of the consoles 36, 38 to be reduced, thereby allowing for a larger forward passenger area 32. Latches (not shown) maintain the right and left windshields 102, 106 in their first shielding positions. It is contemplated that the central and side slide frames 110, 112 could be moved inside the consoles 36, 38 or completely removed when the windshields 102, 104, 106 are in their retracted positions As shown in FIGS. 7 to 9, all of the windshields 102, 104, 106 and the door 100 can be retracted at the same time. The central and side slide frames 110, 112 are arranged such that, when the right windshield 102 is retracted and the door 100 is opened, the right windshield 102 is disposed forwardly of the door 100 inside the console 36.

Turning now to FIGS. 10 to 22, a second embodiment of a boat 10 in accordance with the present invention is shown. For simplicity, elements of the second embodiment which are the same or similar to those found in the first embodiment have been labeled with the same reference number and will only be described as necessary.

Figure 12:
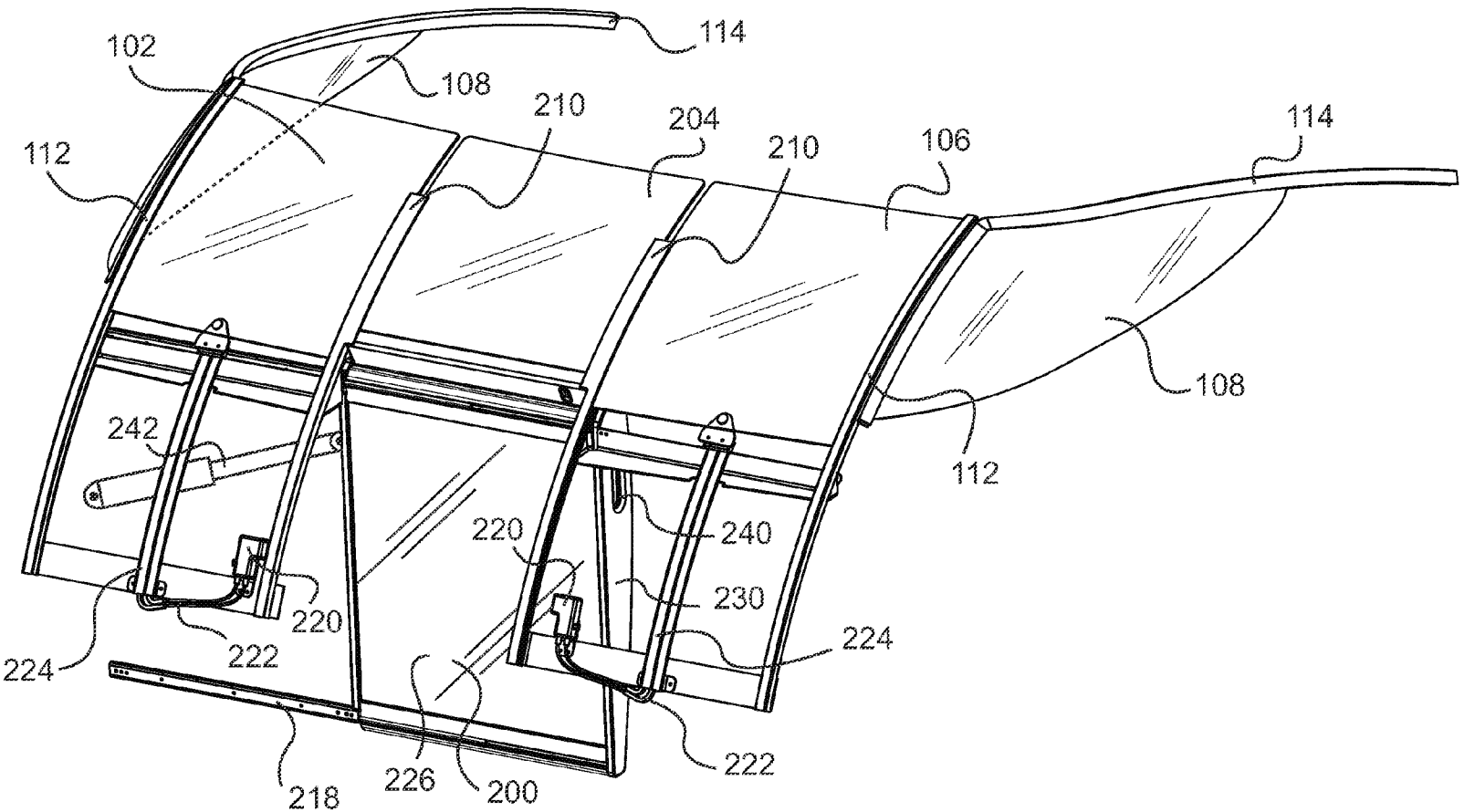
FIG. 12 is a perspective view, taken from a front, left side, of a windshield and door system of the boat of FIG. 10, with the windshields in the shielding position and the door in the closed position.
Figure 13:
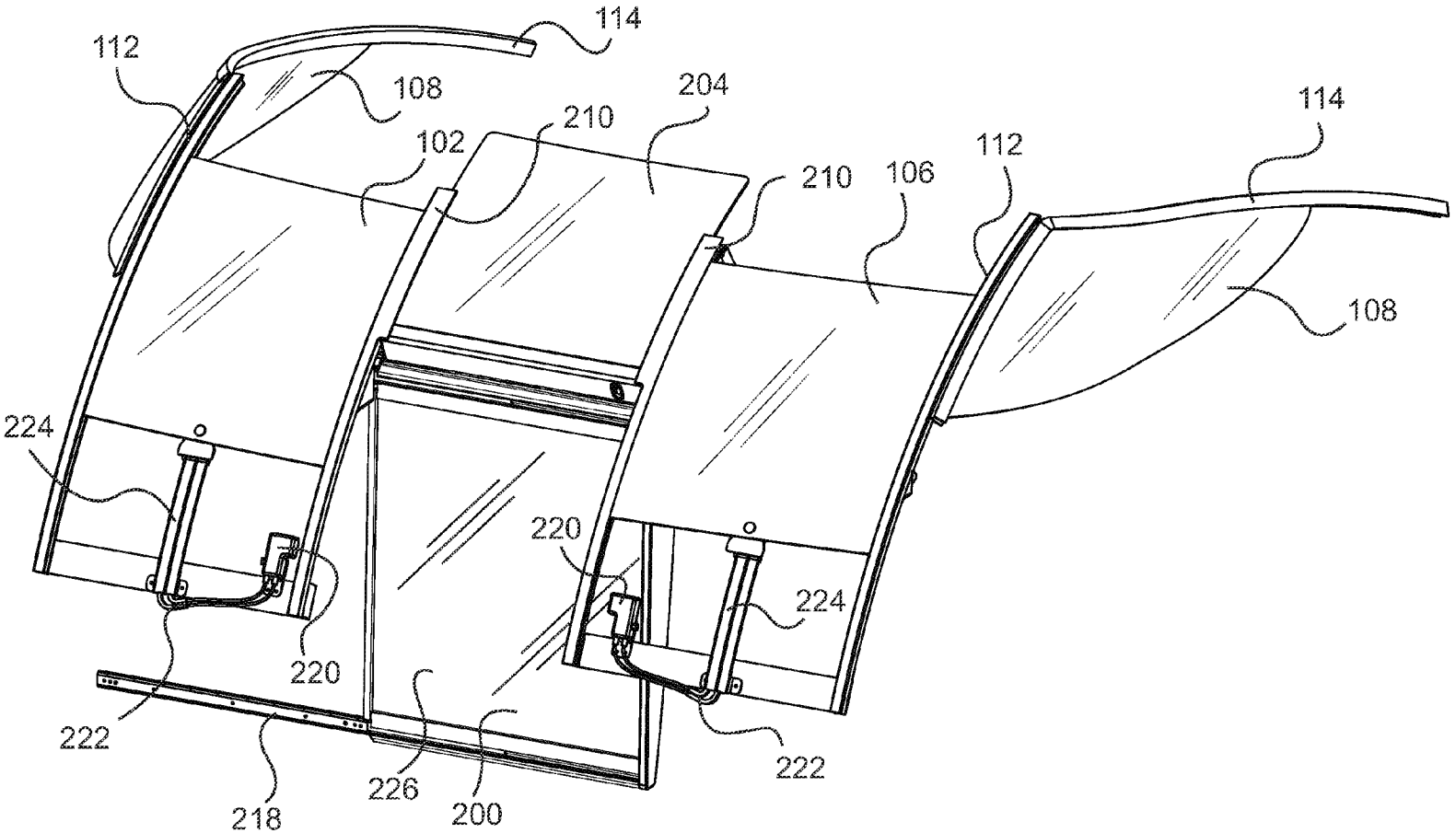
FIG. 13 is a perspective view, taken from a front, left side, of the windshield and door system of FIG. 12, with the left and right windshields in a partially retracted position.
Figure 14:
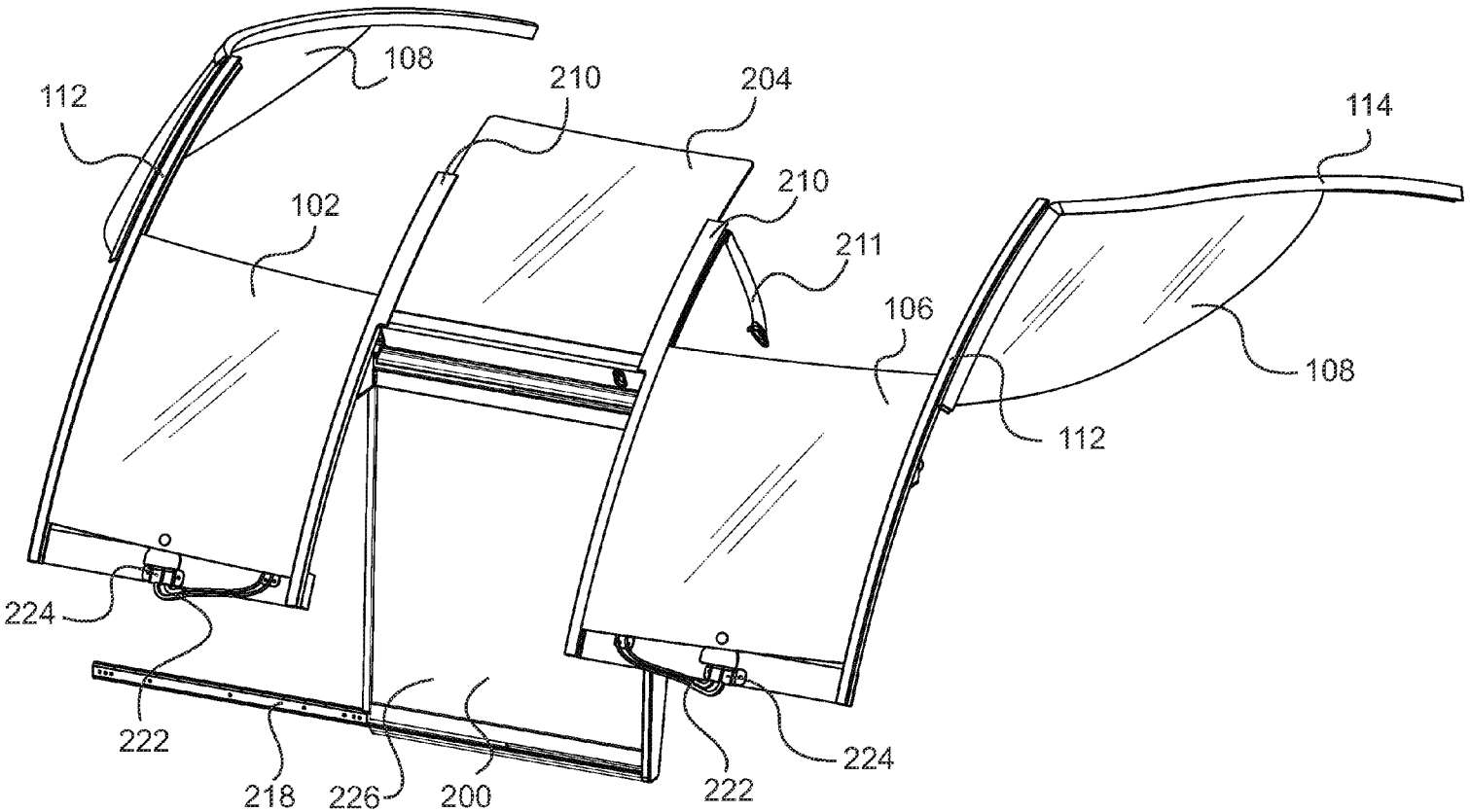
FIG. 14 is a perspective view, taken from a front, left side, of the windshield and door system of FIG. 12, with the left and right windshields in a retracted position.

As best seen in FIGS. 12 to 14, the right and left windshields 102, 106 can move between a first shielding position (FIG. 12), where they extend a first distance vertically above their respective consoles 36, 38, and a second retracted position (FIG. 14), where they extend below their respective consoles 36, 38. The right and left windshields 102, 106 can also be moved to a partially retracted position (FIG. 13) where they extend a distance vertically above their respective consoles 36, 38 which is less than the first distance. Each of the right and left windshields 102 and 104 has a slightly curved vertical cross-section. The axis of curvature of each of the right and left windshields 102 and 104 is preferably located below the floor of the deck 30 forwardly of the transom of the boat 10. Each of the right and left windshields 102 and 104 also has a slightly curved horizontal cross-section. The right and left windshields 102, 106 are each held on one side by a corresponding central slide frame 210 and on the other side by a corresponding side slide frame 112. A support 211 (FIG. 18) is provided between each central slide frame 210 and its corresponding console 36 or 38 to help support the windshields 102, 204, 106. The right and left windshields 102, 106 slide in their corresponding central and side slide frames 112 between their various positions. An electric motor 220 is provided inside each console 36, 38 and each electric motor 220 is connected to its respective windshield 102 or 106 via cables 222 located inside a track 224. The electric motors 220 and cables 222 are used to raise or lower the windshields 102, 106. It is contemplated that other actuators or mechanisms could be used to slide the windshields 102, 106 between their various positions. For example, the electric motors 220 could be connected to the windshields 102, 106 via a rack and pinion assembly, or a hydraulic or pneumatic actuator could be used. Although they are shown as moving together in the FIGS. 12-14, it is contemplated that the right and left windshields 102, 106 could move independently of each other.

It is also contemplated that the windshields 102, 106 could move automatically based on the speed of the boat 10. A speed sensor would send a signal representative of the speed to an electronic control unit which would in turn send a signal to the electric motors 220 to move the windshields 102, 106 to a position based on the speed signal. At rest and/or at speeds lower than a first predetermined speed, the windshields 102, 106 would be moved to their second retracted position. At speeds higher than a second predetermined speed, the windshields 102, 106 would be moved to their first shielding position. The windshields 102, 106 would be moved to intermediate positions for intermediate speeds (i.e. speeds between the upper and lower predetermined speeds). For example, the intermediate positions could be proportional to the intermediate speeds.

Figure 16:
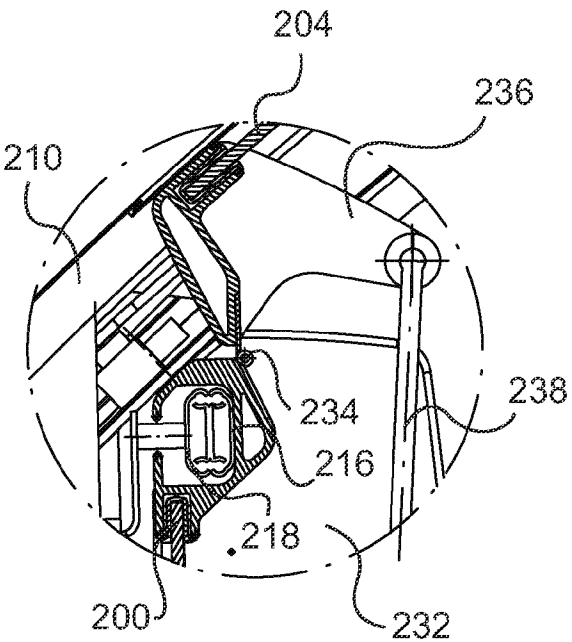
FIG. 16 is a close-up view of the section labeled FIG. 16 in FIG. 15.
Figure 15:
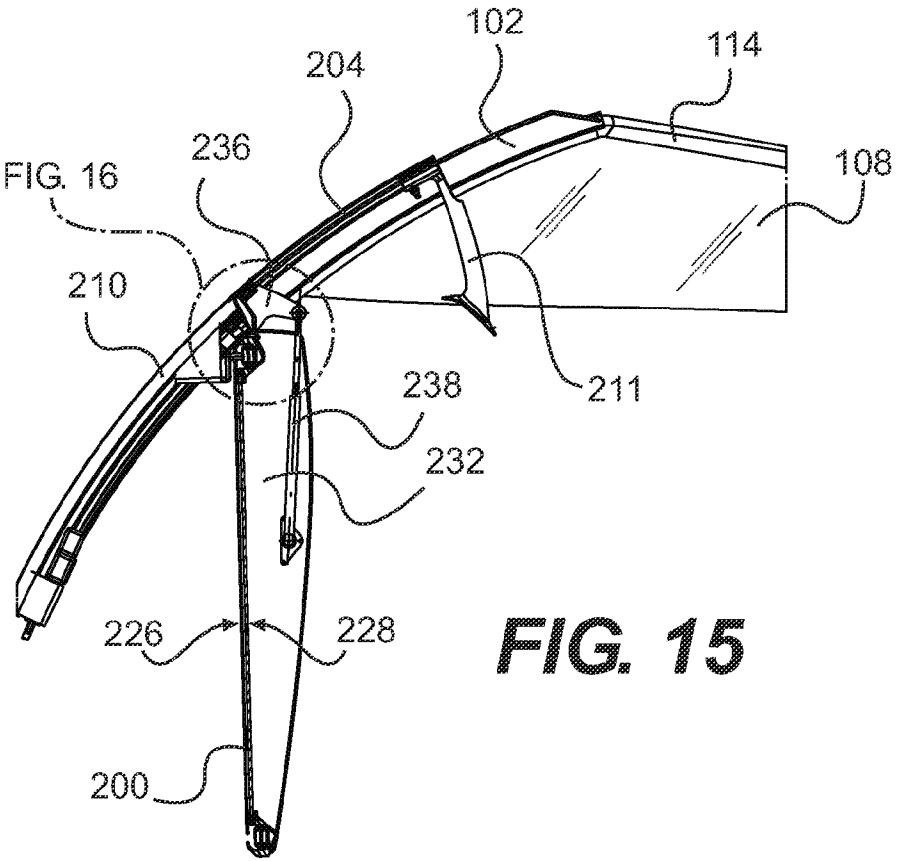
FIG. 15 is a cross-sectional view, taken vertically through a center of the door and central windshield of FIG. 12, with the central windshield in the shielding position.
Figure 22:
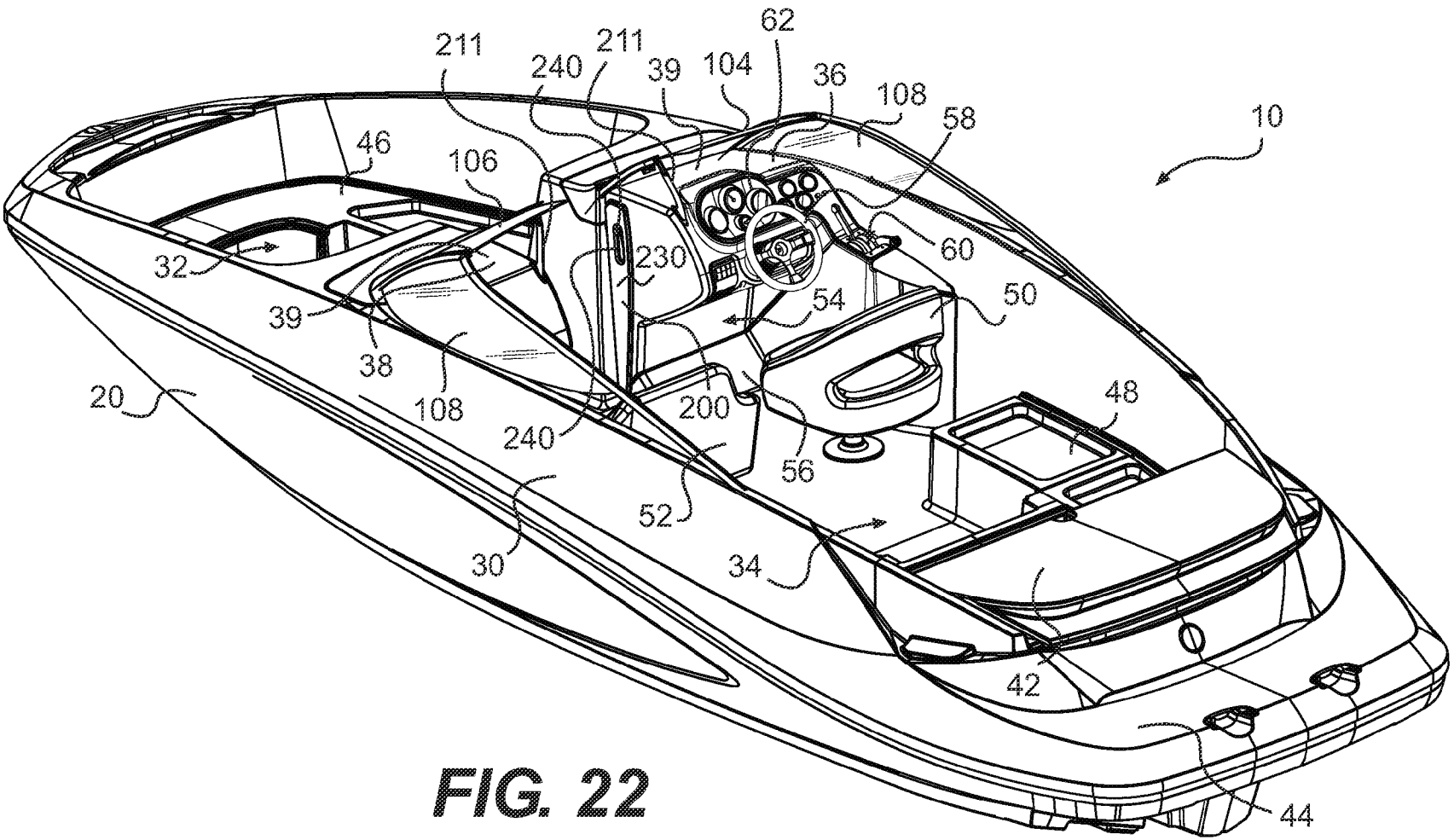
FIG. 22 is a perspective view, taken from a rear, left side, of the boat of FIG. 10, with the central windshield in a shielding position and the door in the opened position.

Returning to FIGS. 10 and 11, a door 200 is disposed on the deck 30 for selectively closing the passageway 40 between the forward and rearward passenger areas 32, 34. As will be described in more details below, and as shown in FIG. 22, the door 200 can be retracted inside the right console 36. The door 200 has a front 226, a back 228, and two sides 230, 232. The door 200 is attached to a pair of slide rails, as shown in FIGS. 15 and 16. Fixed portions 218 of the slide rails are located inside the right console 36, and sliding portions 216 of the slide rails are attached to the door 200. It is also contemplated that the door 200 could be retracted inside the left console 38, or that the door 200 could pivot between its opened and closed positions about a vertical axis located to one side of the door 200.

Figure 10:
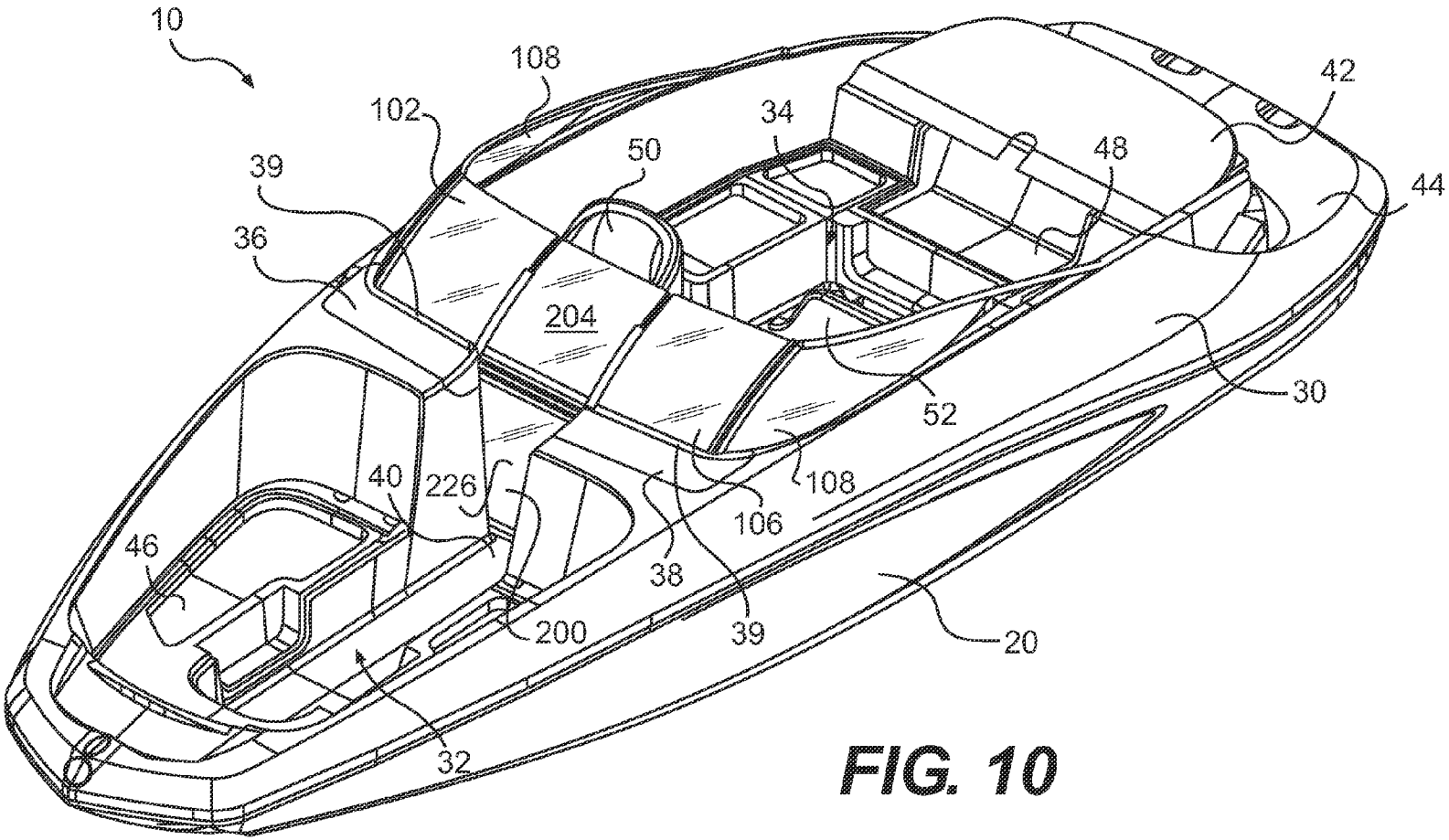
FIG. 10 is a perspective view, taken from a front, left side, of a second embodiment of a boat in accordance with the present invention, with the windshields in a shielding position and the door in a closed position.
Figure 11:
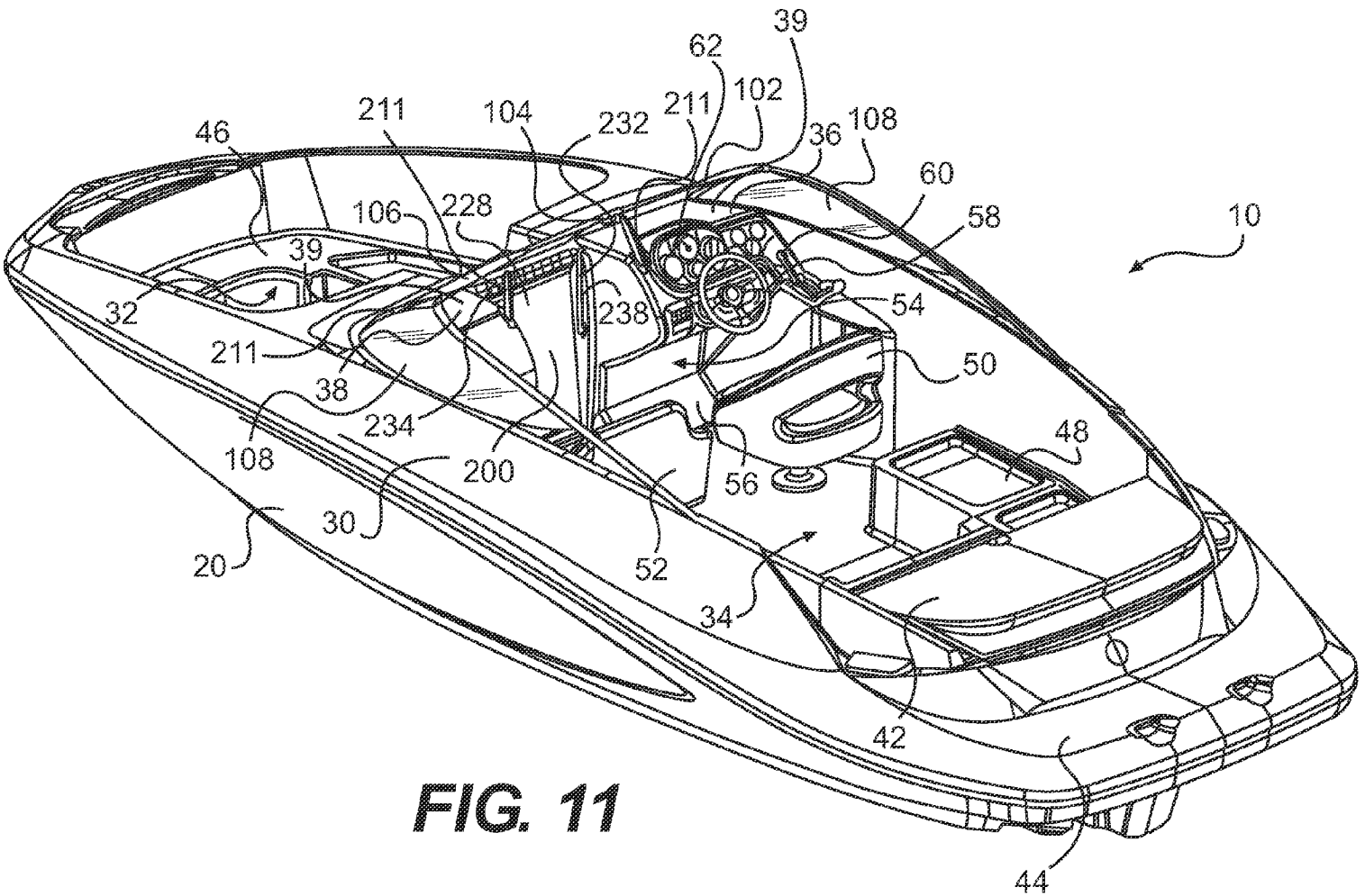
FIG. 11 is a perspective view, taken from a rear, left side, of the boat of FIG. 10.
Figure 17:
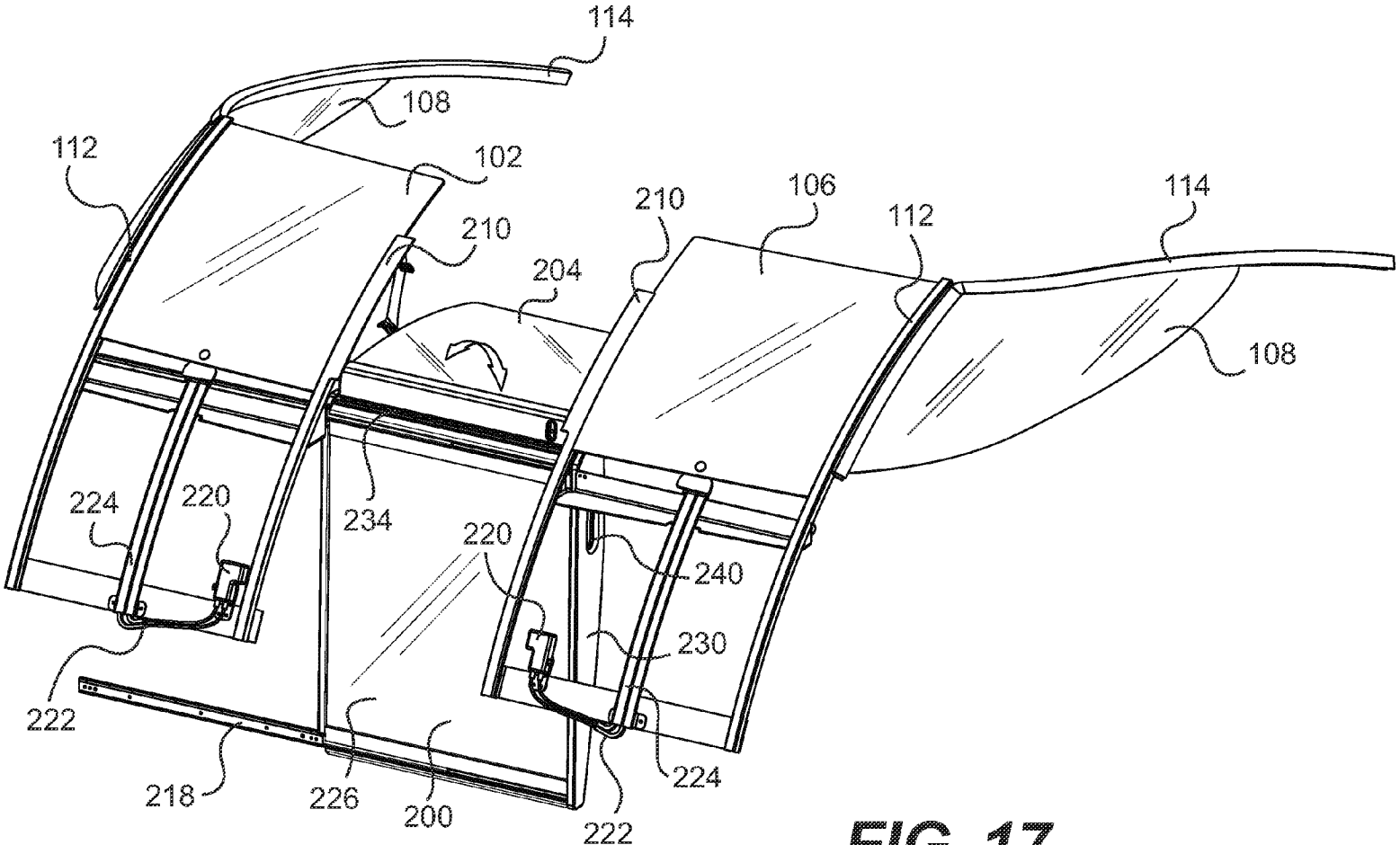
FIG. 17 is a perspective view, taken from a front, left side, of the windshield and door system of FIG. 12, with the central windshield in a partially retracted position and the door in the closed position.
Figure 18:
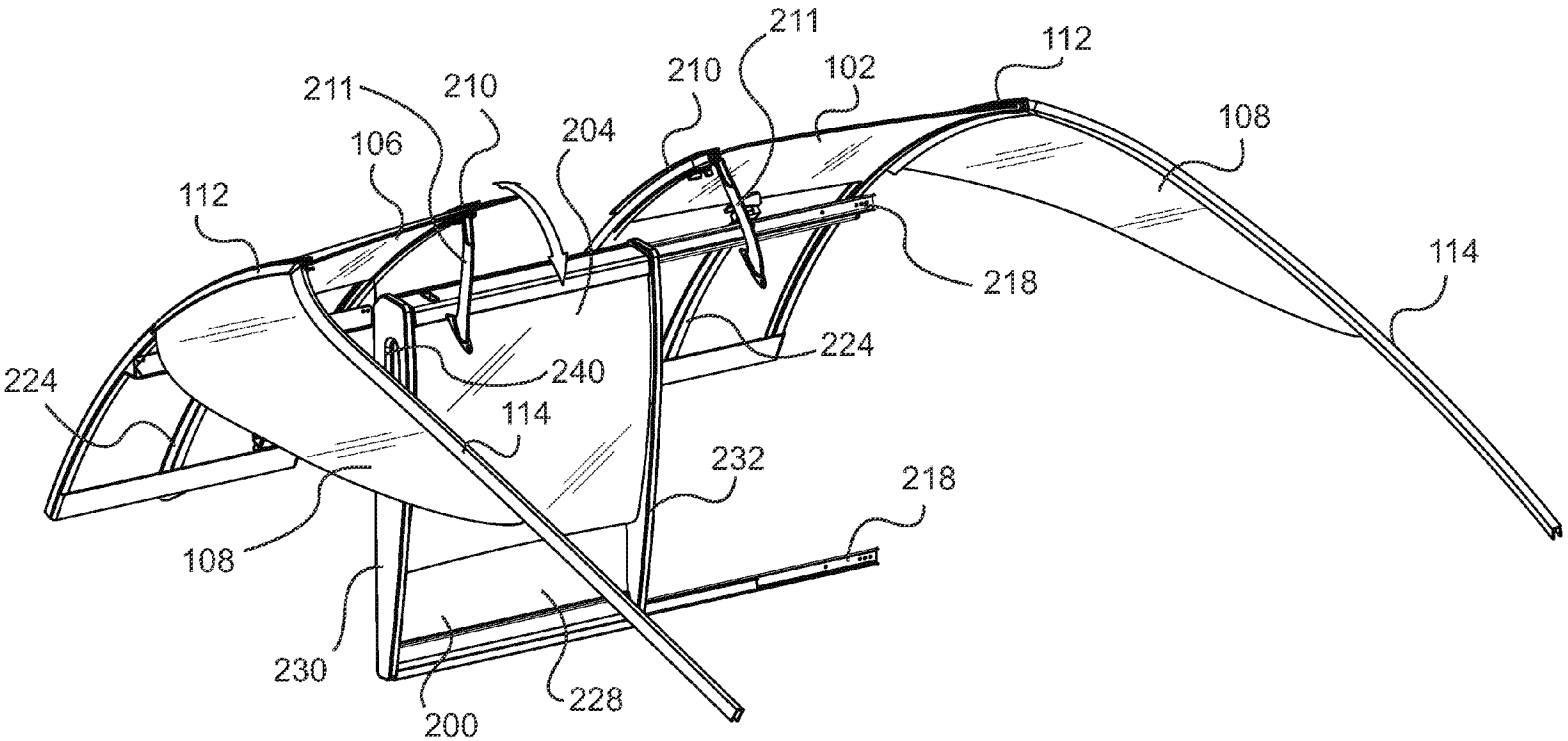
FIG. 18 is a perspective view, taken from a rear, left side, of the windshield and door system of FIG. 12, with the central windshield in a retracted position and the door in the closed position.
Figure 20:
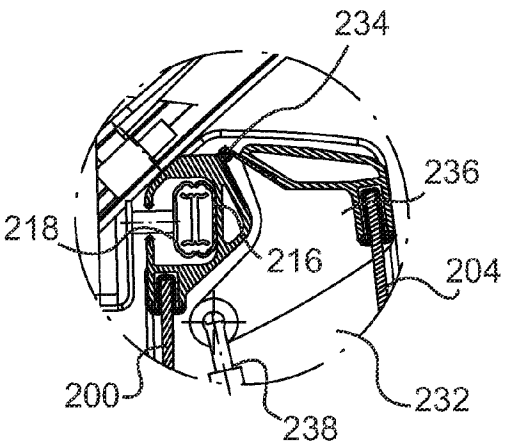
FIG. 20 is a close-up view of the section labeled FIG. 20 in FIG. 19.
Figure 19:
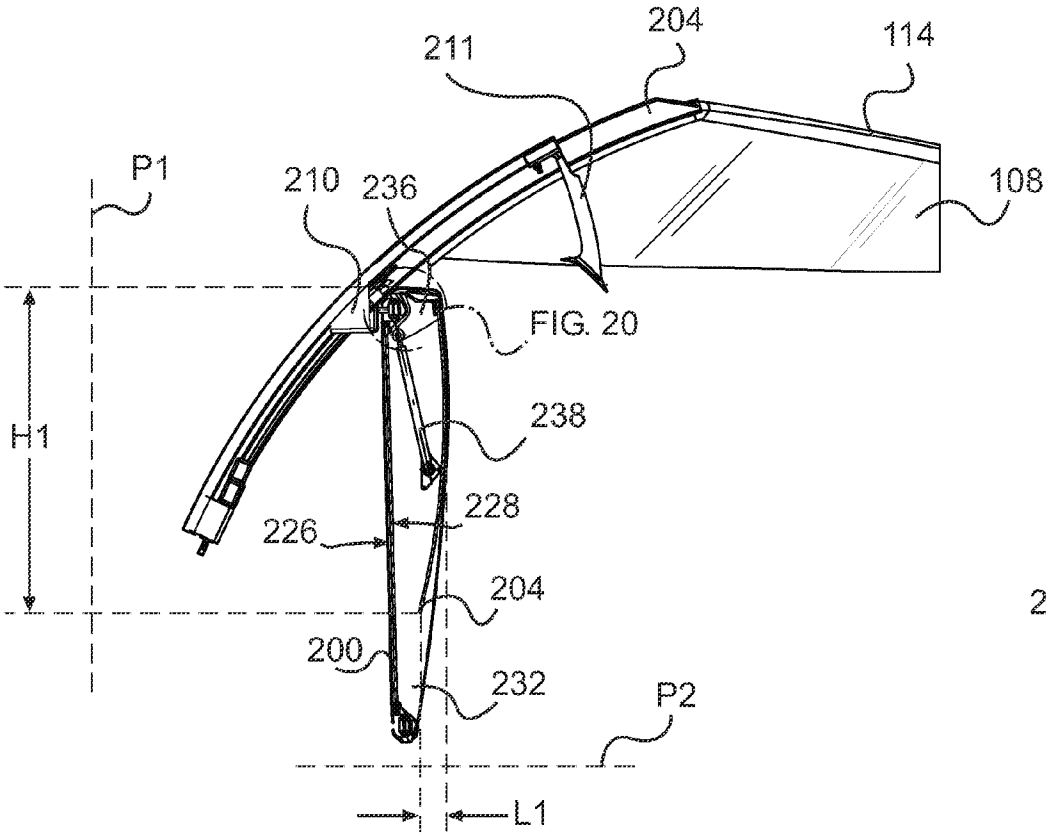
FIG. 19 is a cross-sectional view, taken vertically through a center of the door and central windshield of FIG. 18, with the central windshield in the retracted position.

A central windshield 204 can be moved to a first shielding position where it extends a first distance vertically above the door 200 when the door 200 is in a closed position, as shown FIG. 10. As will be explained below, the central windshield 204 can be rotated about a horizontal axis to a second retracted position where the central windshield 204 extends below the top of the door 200. As seen in FIG. 15, the central windshield 204 has a slightly curved vertical cross-section. The axis of curvature of the central windshield 204 in its shielding position is preferably located below the floor of the deck 30 forwardly of the transom of the boat 10. The central windshield 204 also has a slightly curved horizontal cross-section. The central windshield 204 is hinged to the door 200 by a hinge 234 (FIG. 16). This allows the central windshield 204 to be rotated from the first shielding position, shown in FIGS. 14-16, to an intermediate position, shown in FIG. 17, and finally to the second retracted position lying against the back 228 of door 200, as shown in FIGS. 18-21. When in the second retracted position, as shown in FIG. 19, the central windshield 204 is in a substantially vertical position. This means that a height H1 of the projection of the central windshield 204 onto a vertical plane P1 facing the central windshield 204 is greater than a length L1 (measured perpendicularly to the plane P1) of the projection of the central windshield 204 onto a horizontal plane P2. Note that the central frames 210 are shaped to prevent the central windshield 204 to be rotated too far forward when it is moved back to a shielding position. It is contemplated that the central windshield 204 could be rotated down to a retracted position lying against the front 226 of the door 200. It is also contemplated that the central windshield 204 could rotate only partially, as shown in FIG. 17, so as to adjust a degree of shielding provided thereby. When rotated only partially, the central windshield 204 extends a distance vertically above the top of the door 200 which is less than the first distance where the central windshield 204 is in its first shielding position As seen in FIGS. 15 and 16, a bracket 236 is connected to a bottom of the central windshield 234. A strut 238 having a variable length is connected at one end to the bracket 236 and at the other end to the side 232 of the door 200. The strut 238 prevents the central windshield 204 from being moved suddenly to its second retracted position (if it is dropped while being moved for example). The strut 238 also assists in raising the central windshield 204 back to its first shielding position. It is contemplated that a bracket and a strut attached to the side 230 of the door 200 could be provided on the left of the central windshield 204 in addition to or instead of the bracket 236 and strut 238. It is also contemplated that the strut 238 could be replaced by an electrical or an hydraulic actuator to automatically raise or lower the central windshield 204 based on boat speed or by using a user-operated switch.

Figure 21:
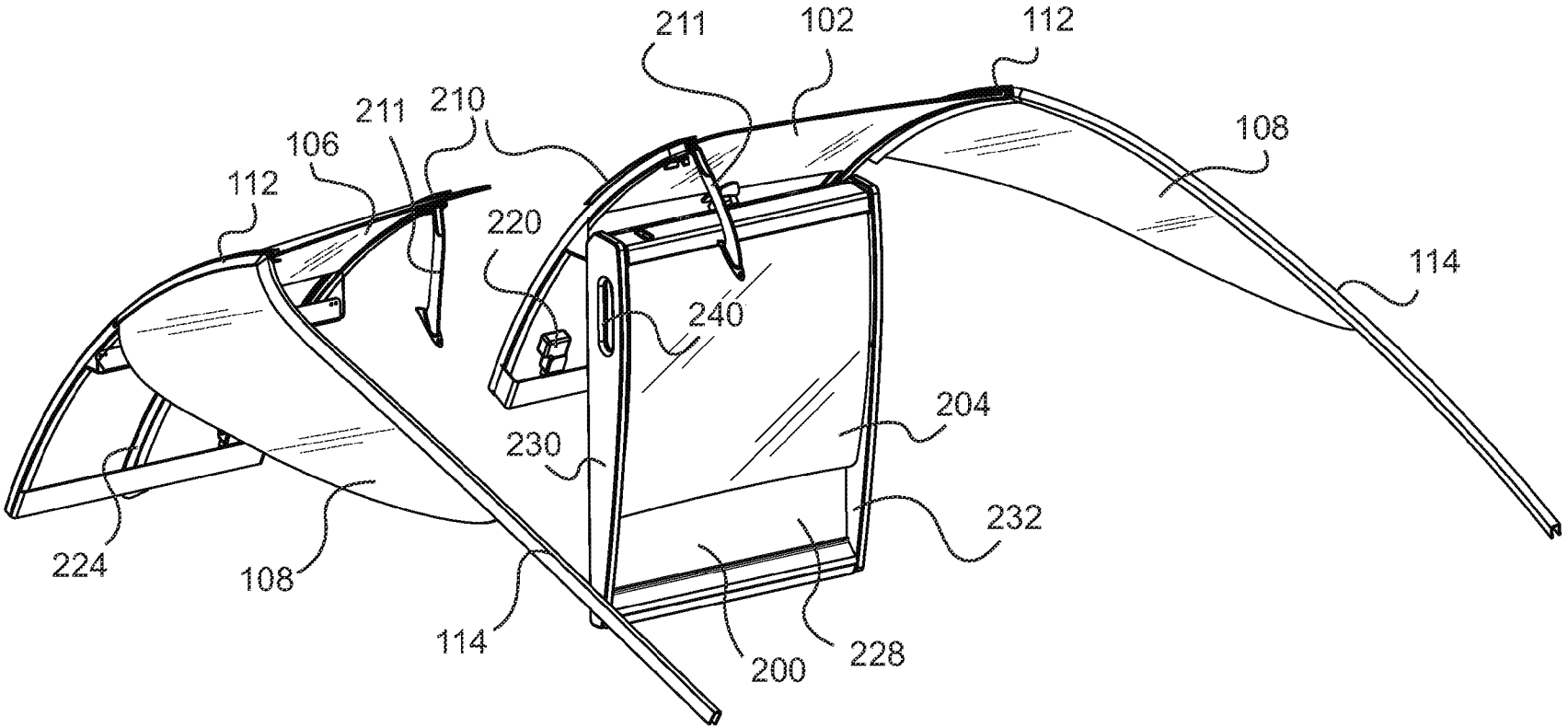
FIG. 21 is a perspective view, taken from a rear, left side, of the windshield and door system of FIG. 12, with the central windshield in a retracted position and the door in an opened position.

Once the central windshield 204 is rotated down against the door 200, the door 200 can be pushed along the slide rails 216, 218 inside the right console 36 to an open position, as shown in FIGS. 21 and 22. The reverse method is used to close the door 200. A handle 240 is provided on the side 230 of the door 200. As shown in FIG. 22, when the door 200 and central windshield 204 are located inside the console 236, the handle 240 can be grabbed to close the door 200. It is contemplated, as shown in FIG. 12, that a strut 242 having a first end connected inside the right console 36 and a second end connected to the door 200 could be provided to help maintain the door 200 in a given position.

All of the windshields 102, 204, 106 and the door 200 can be retracted at the same time. When retracted, the right windshield 102 is disposed forwardly of the door 200.

Figure 23A:
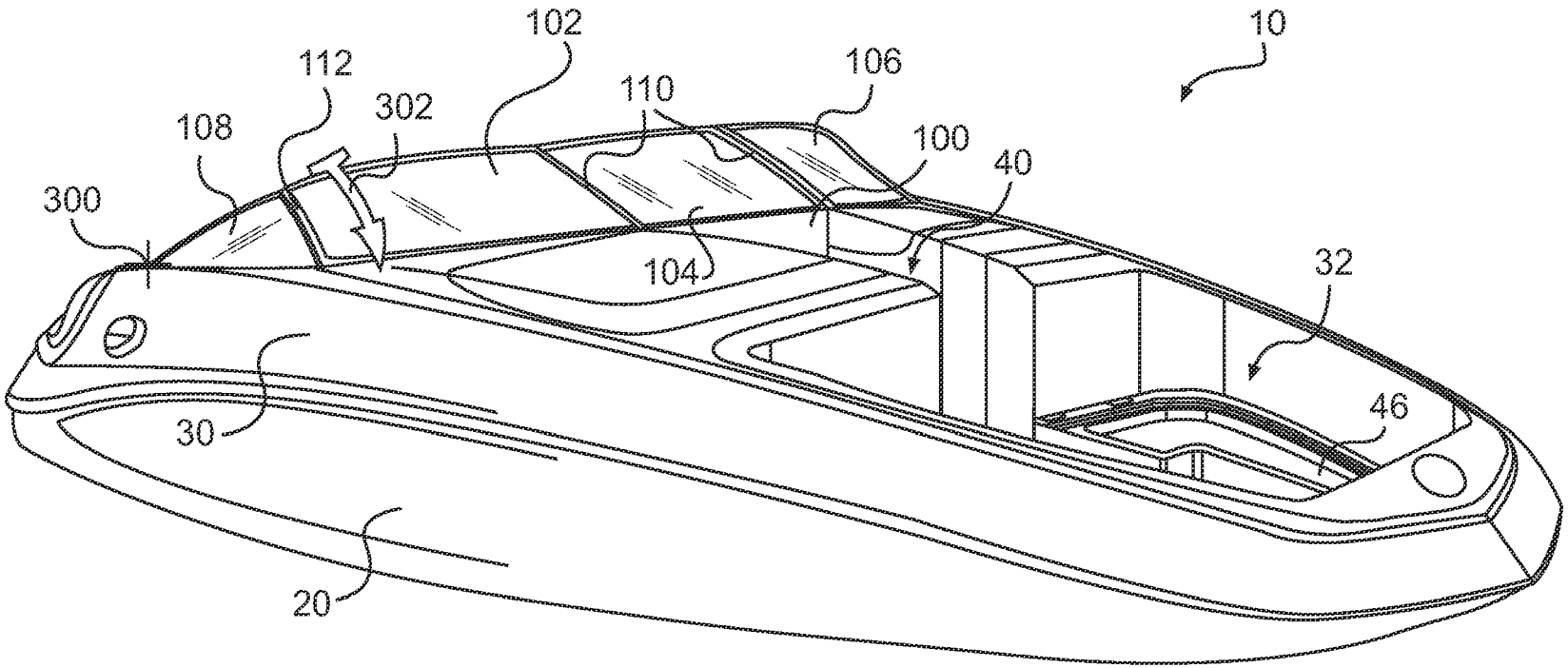
FIG. 23A is a close perspective view, taken from a front, left side, of a boat with a side windshield in a shielding position.
Figure 23B:
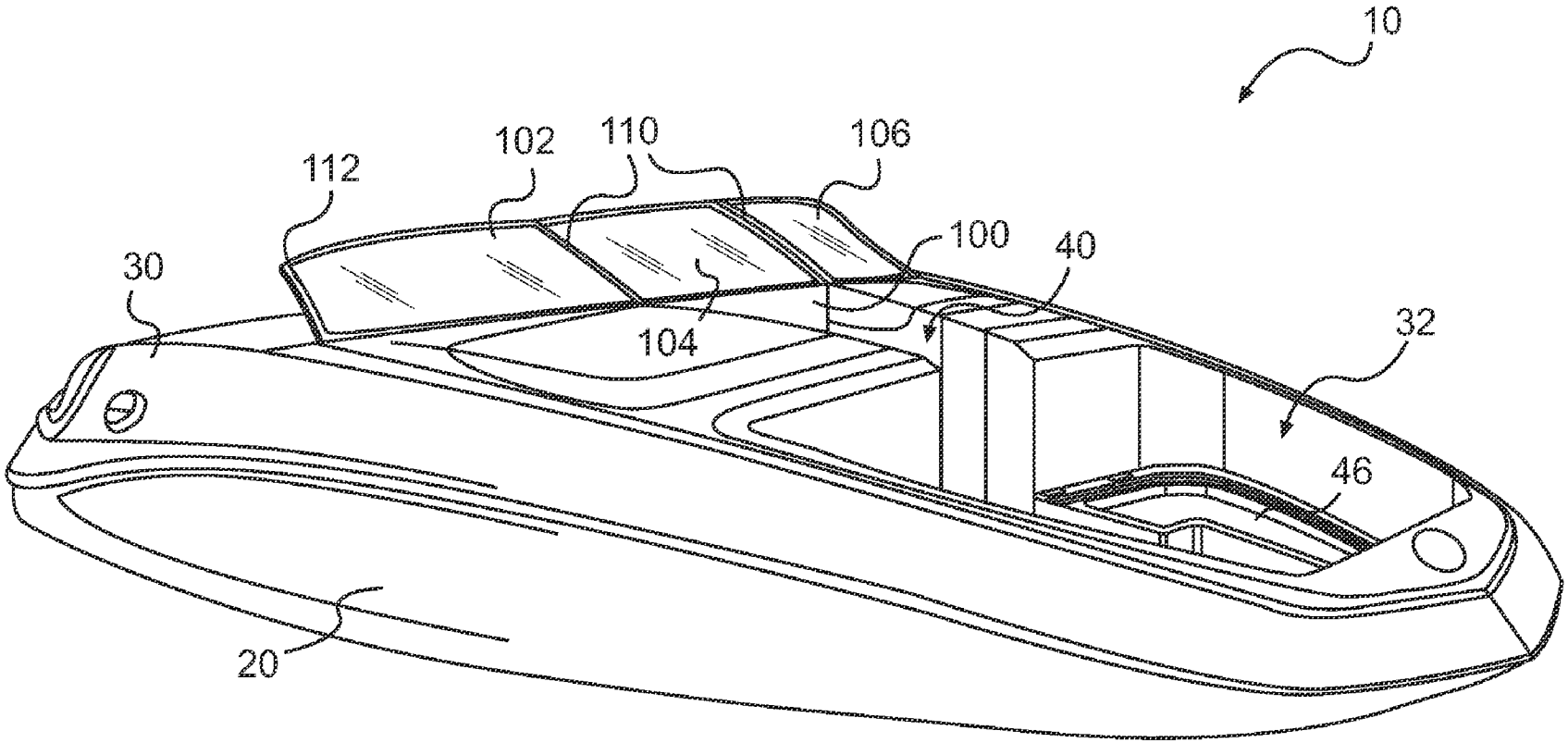
FIG. 23B is a perspective view, taken from the front left side, of the boat of FIG. 23A with the side windshield in a retracted position.

It is contemplated, as shown in FIGS. 23A and 23B, that the side windshields 108 could also be moved from a shielding position (shown in FIG. 23A) to a retracted position (shown in FIG. 23B). A pivot point 300 is located at a back of each side windshield 108. The side windshields 108 are moved from their shielding position to their retracted position by pivoting them about their respective pivot point 300 in the direction of arrow 302. The pivot points 300 are oriented such that, when in their retracted position, the side windshields 108 are located inside a side of the deck 30.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A boat comprising:

a hull;

a deck supported by the hull, the deck having a rearward passenger area;

a seat disposed in the rearward passenger area;

a first console disposed on the deck at a front of the rearward passenger area and forwardly of the seat on a first side of a longitudinal axis of the boat, the first console having a top;

a first windshield disposed generally transverse to and on the first side of the longitudinal axis of the boat, the first windshield being movable between a first position where the first windshield extends a first distance vertically above the top of the first console and a second position where at least a portion of the first windshield extends a second distance vertically below the top of the first console, when the first windshield is in the second position the at least one portion of the first windshield is in a substantially vertical position;

a second console disposed on the deck on a second side of the longitudinal axis of the boat, the second console having a top; and a second windshield disposed on the second side of the longitudinal axis of the boat.

2. The boat of claim 1, wherein, when in the second position, the at least one portion of the first windshield is disposed inside the first console.

3. The boat of claim 1, wherein, when in the second position, the first windshield is completely below the top of the first console.

4. The boat of claim 1, wherein the first windshield slides between the first and the second positions.

5. The boat of claim 4, further comprising a pair of slide frames connected to the first console; and wherein the first windshield slides in the slide frames when moving between the first and the second positions.

6. The boat of claim 1, further comprising a side windshield disposed at an angle to the first windshield; and wherein the side windshield is movable between a first position where the side windshield is disposed above a side of the deck and a second position where at least a portion of the side windshield is disposed below the side of the deck.

7. The boat of claim 6, wherein the side windshield pivots between the first and the second positions.

8. The boat of claim 1, wherein the second windshield is movable between a first position where the second windshield extends a third distance vertically above the top of the second console and a second position where at least a portion of the second windshield extends a fourth distance vertically below the top of the second console, when the second windshield is in the second position the at least one portion of the second windshield is in a substantially vertical position.

9. The boat of claim 8, wherein the first and second windshields slide between their respective first and second positions.

10. The boat of claim 8, wherein, when the first windshield is in its second position, the at least one portion of the first windshield is disposed inside the first console; and wherein, when the second windshield is in its second position, the at least one portion of the second windshield is disposed inside the second console.

11. The boat of claim 1, further comprising a third windshield disposed between the first and second windshields, such that when the first windshield is in the first position, the first, second, and third windshields form together a continuous windshield spanning a majority of a width of the deck.

12. The boat of claim 11, wherein the deck has a forward passenger area; and the boat further comprises:

a passageway between the first and the second consoles allowing for communication between the forward passenger area and the rearward passenger area; and a door disposed on the deck for selectively closing the passageway between the forward passenger area and the rearward passenger area, the door having a top; and wherein the third windshield is operatively connected to the door.

13. The boat of claim 12, wherein the third windshield is movable between a first position where the third windshield extends a fifth distance vertically above the top of the door and a second position where at least a portion of the third windshield extends a sixth distance vertically below the top of the door.

14. The boat of claim 11, wherein each one of the second and third windshields is movable between a first position and a second position; and wherein when in their respective first positions, each of the first, second, and third windshields forms a portion of the continuous windshield.

15. The boat of claim 14, wherein each one of the first, second, and third windshields is movable independently of the others.

16. The boat of claim 14, wherein each one of the first, second, and third windshields is slidable between its respective first and second positions.

17. The boat of claim 14, wherein each of the first and second windshields is slidable between its respective first and second positions; and wherein the third windshield is rotatable between its first and second positions.

18. The boat of claim 1, further comprising an actuator for moving the first windshield between the first and the second positions.

19. The boat of claim 18, wherein the actuator includes an electric motor.

20. The boat of claim 1, wherein the seat is a driver's seat.

* * * * *